US005831515A

United States Patent [19]

Stewart et al.

[11] Patent Number: 5,831,515

[45] Date of Patent: Nov. 3, 1998

[54] ELECTRONIC SIREN APPARATUS INCLUDING AN INTEGRATED HANDHELD MICROPHONE AND CONTROL HANDLE

[75] Inventors: John Stewart; William H. Carson; Mick Cameron, all of Indianapolis; Gregg Santangini, Westfield, all of Ind.

[73] Assignee: Carson Maunfacturing Company, Inc., Indianapolis, Ind.

[21] Appl. No.: 390,699

[22] Filed: Feb. 17, 1995

[51] Int. Cl.[6] ..... G08B 3/10

[52] U.S. Cl. ..... 340/384.4; 340/384.5; 340/384.6; 340/471; 340/384.7

[58] Field of Search ..... 340/384.4, 384.5, 340/384.6, 384.7, 474, 463, 460, 471, 904, 692

[56] References Cited

U.S. PATENT DOCUMENTS

| | | | |
|---|---|---|---|
| 4,075,624 | 2/1978 | Sheff | 340/384.4 |
| 4,189,718 | 2/1980 | Carson et al. | 340/384 |
| 4,239,330 | 12/1980 | Ashkin et al. | 350/96.18 |
| 4,371,750 | 2/1983 | Markley | 179/1 VL |
| 4,646,063 | 2/1987 | Carson | 340/384.4 |
| 4,790,621 | 12/1988 | Calaby et al. | 350/96.2 |
| 4,812,674 | 3/1989 | Sue et al. | 307/116 |
| 4,843,367 | 6/1989 | Saito | 340/463 |
| 5,012,221 | 4/1991 | Neuhaus et al. | 340/384 |
| 5,140,304 | 8/1992 | Miller | 340/742 |
| 5,212,744 | 5/1993 | Ohnuki | 385/16 |
| 5,274,487 | 12/1993 | Fujimoto et al. | 359/117 |
| 5,296,840 | 3/1994 | Gieffers | 340/384.4 |

*Primary Examiner*—Thomas Mullen
*Assistant Examiner*—Julie B. Lieu
*Attorney, Agent, or Firm*—Woodard, Emhardt, Naughton Moriarty & McNett

[57] ABSTRACT

A two-piece electronic siren apparatus including an integrated handheld microphone and control handle and a receiver/amplifier box is provided. The microphone and control handle permits handheld control of emergency light functions, siren functions, and auxiliary functions, as well as allowing a user to talk through a speaker. The integrated receiver/amplifier box includes both a siren board and a relay board. The siren board includes a microprocessor capable of generating siren tones and of controlling, among other things, a power amplifier located on the siren board, and auxiliary devices and functions. Additionally, the microprocessor controls two default modes of operation of the siren and/or light circuitry.

3 Claims, 39 Drawing Sheets

TONE CYCLE ALTERNATOR SECTION

TCA OPTION ON ?
N
Y
SIREN SETTING= PHAS, WAIL, OR YELP ?
N
Y
LAST SIREN SETTING EXIST ? (SIR.L$)
N
UPDATE LAST SIREN SETTING (ACCA->SIR.L$)
Y
TCA FLAG ON ?
TURN TCA FLAG ON
Y
SIREN SETTING CHG. ? (<> SIR.L$)
N
CREATE CURRENT RANDOM SIREN SETTING (ACCA ->)
Y
RANDOM TIMER INTERRUPT ?
N
Y
CALCULATE NEXT RANDOM SIREN SETTING
=PREVIOUS SETTING ?

ELECTRONIC SIREN APPARATUS INCLUDING AN INTEGRATED HANDHELD MICROPHONE AND CONTROL HANDLE

BACKGROUND OF THE INVENTION

1. Field of the Invention

This invention relates to the field of electronic sirens and more specifically to an electronic siren apparatus wherein microphone, siren function, emergency light control, and auxiliary functions are all controllable from a portable handheld unit.

2. Description of the Prior Art

Electronic sirens and warning devices are well known in the art and are commonly available. U.S. Pat. No. 4,189,718 to Carson et al., describes an electronic siren comprising in combination circuitry for generating one of a square wave siren and intelligible audio signal and a power output amplifier for audibly reproducing the signal. Additionally, U.S. Pat. Nos. 4,075,624 to Sheff, 4,040,050 and 4,980,837 to Nunn et al., 5,012,221 to Neuhaus et al., and U.S. Pat. No. 4,668,938 to Bosnak show other forms of electronic sirens.

It is further known in the siren and alarm art to use a microprocessor or microcontroller to create the tones that are used to drive a speaker. U.S. Pat. Nos. 4,668,937 to Shota, 4,724,424 to Nakashima et al. and Fubini et al., are examples of such systems. U.S. Pat. Nos. 4,980,837 to Nunn et al., 5,012,221 to Neuhaus et al., and 5,296,840 to Gieffers show the use of either a microprocessor or a microcontroller to create siren tones which are amplified and used to drive a speaker.

Referring now to FIGS. 1A and 1B, there are shown two types of electronic siren systems known in the art. More particularly in FIG. 1A there is shown an electronic siren system, such as that disclosed in U.S. Pat. No. 4,646,063 to Carson et al., incorporated herein by reference, wherein an electronic siren system 20 may be split into two component parts comprising a remote control head 21 and a receiver/amplifier box 40, which are connected by a single control line 45. Light bar controls 22, siren/override control 25, auxiliary function switches 23 and 24, siren tone/speaker control rotary switch 26, as well as the power switch (not shown) are all located on the control head 21. Microphone 30 having push-to-talk switch 32 is additionally connected to the control head 21, via conductor 35. In Carson '063, it is stated that the circuitry is split into two parts so as to enable the control head 10 to be relatively small and compact, so that it may be mounted, typically, in the dashboard or on the steering column of the vehicle. The receiver/amplifier box is larger and may be mounted at any desired location in the vehicle such as under a seat, in the vehicle's trunk or the like in accordance with available space. FIG. 1B shows an electronic siren system, wherein the control head and the amplifier are integrated into one unit 20'. None of the prior art systems show an electronic siren system wherein the microphone is integrated with the siren, light bar and auxiliary device controls in a single handheld unit.

There is a need for an electronic siren system which is compact and may be handheld and wherein all system controls are operable from that single handheld unit.

SUMMARY OF THE INVENTION

Further objects and advantages of the present invention may be discerned by persons of ordinary skill in the art after reviewing the following written description and accompanying figures.

DESCRIPTION OF THE PREFERRED EMBODIMENT

Figure 1A:
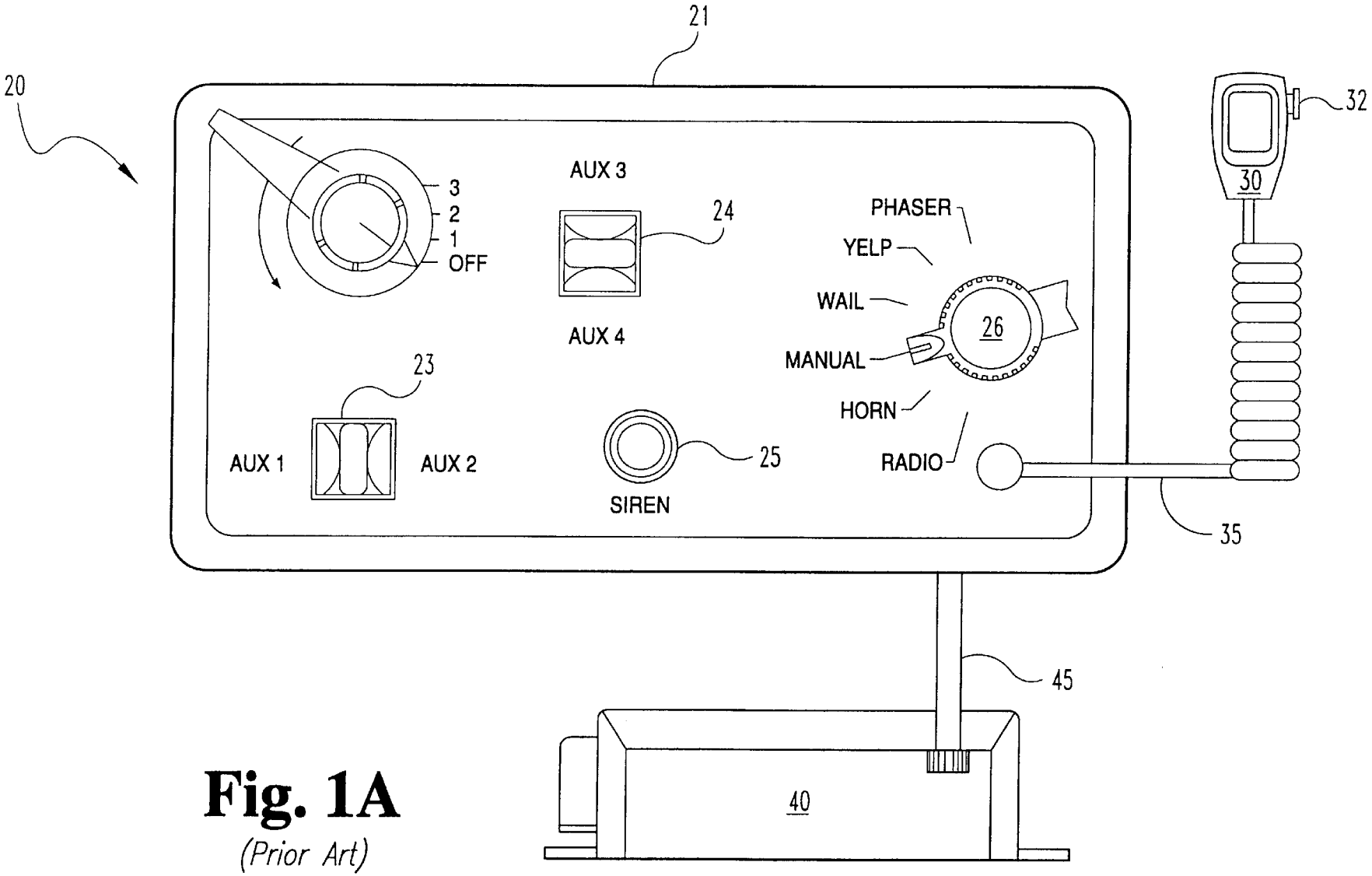
Fig. 1A (Prior Art)
FIG. 1A and 1B are illustrations of prior art electronic siren devices having separate microphones and control heads.
Figure 1B:
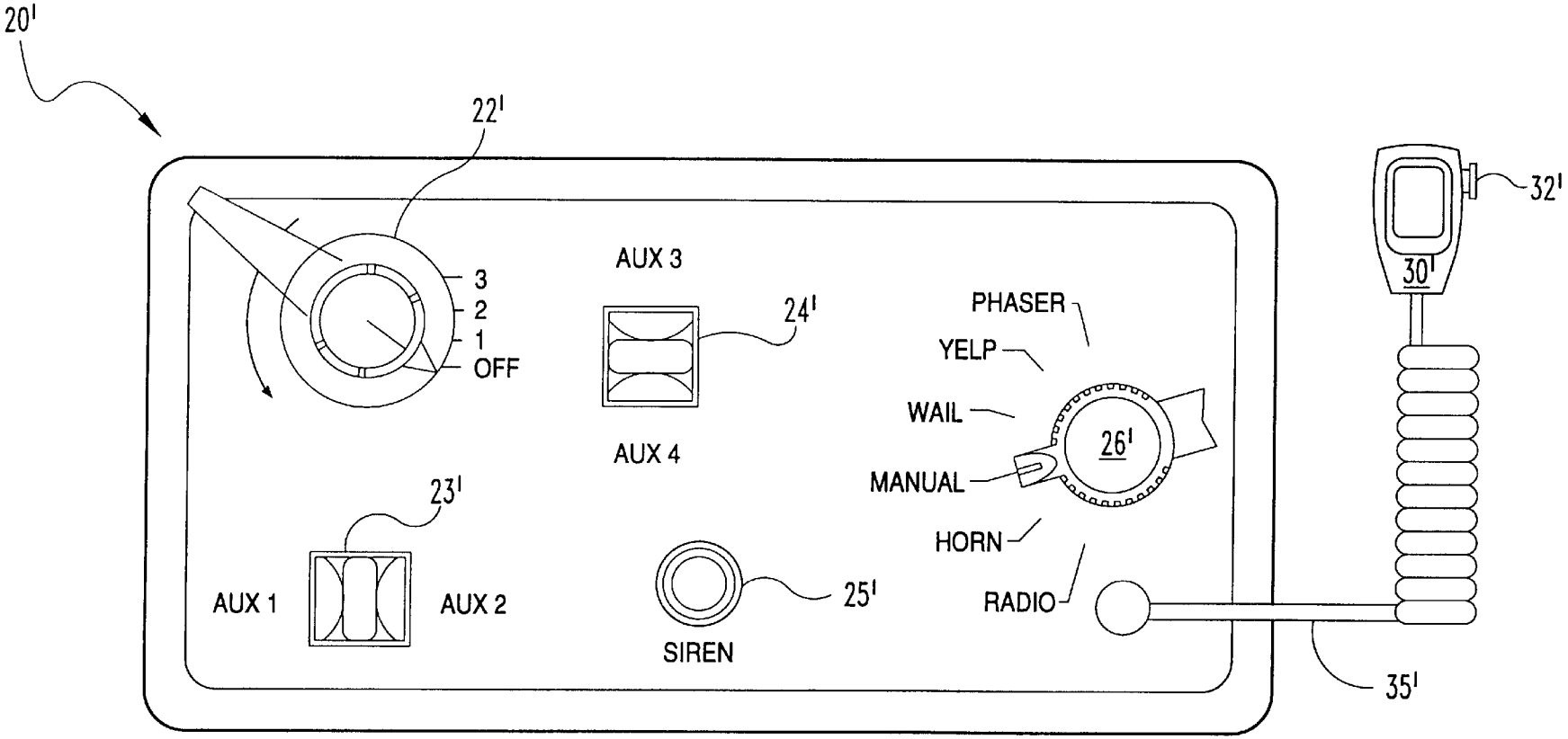
Fig. 1B (Prior Art)

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
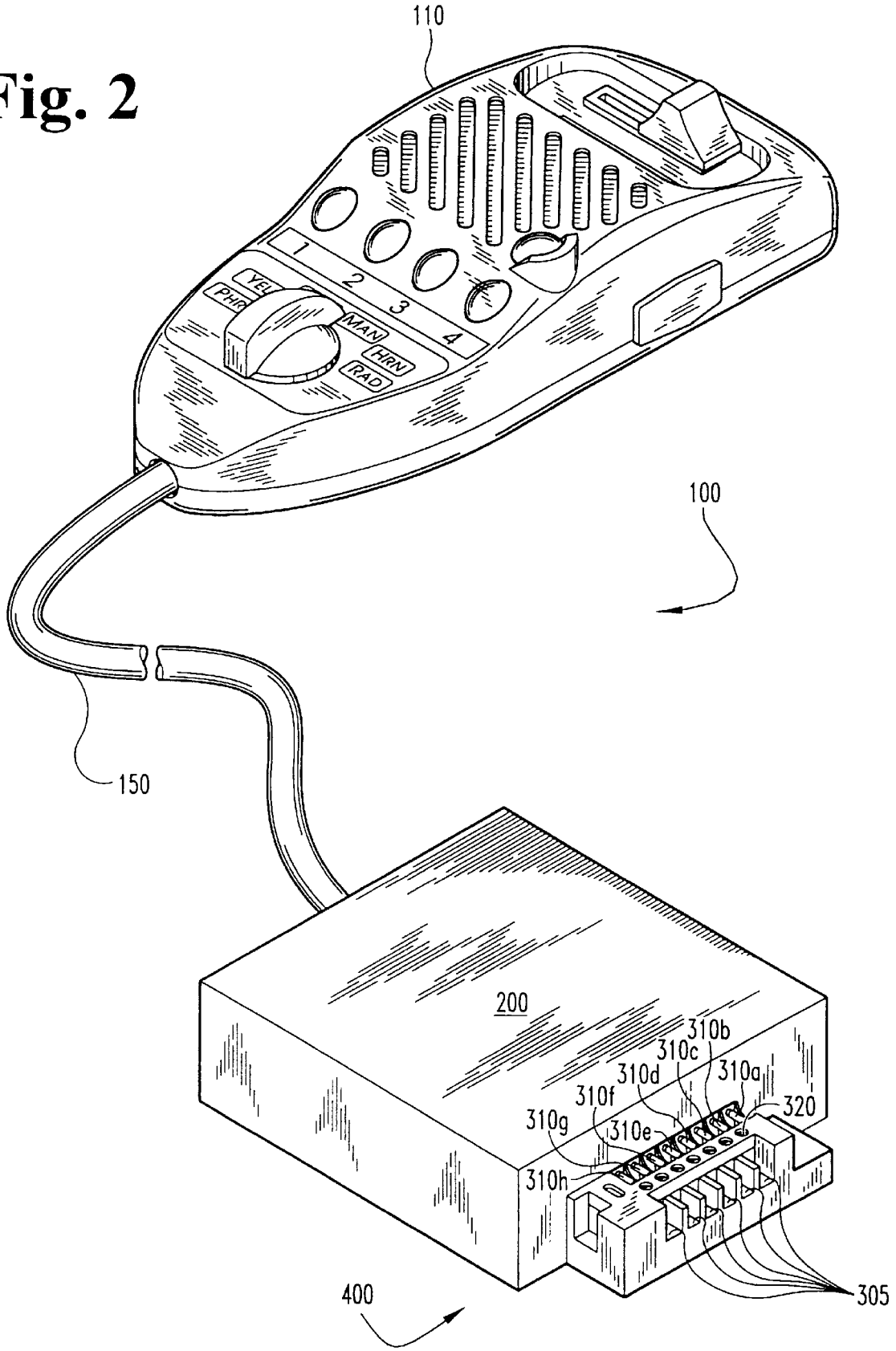
FIG. 2 is an perspective view of a preferred embodiment of the electronic siren apparatus including an integrated handheld microphone and control device of the present invention.
Figure 3A:
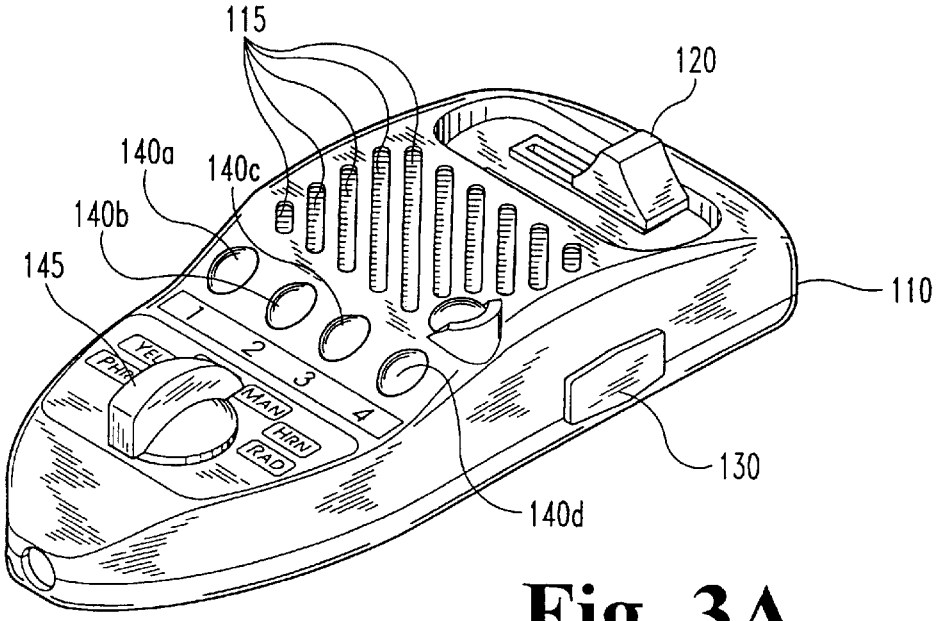
FIG. 3A is a perspective view of the integrated handheld microphone and control device of FIG. 2.
Figure 3B:
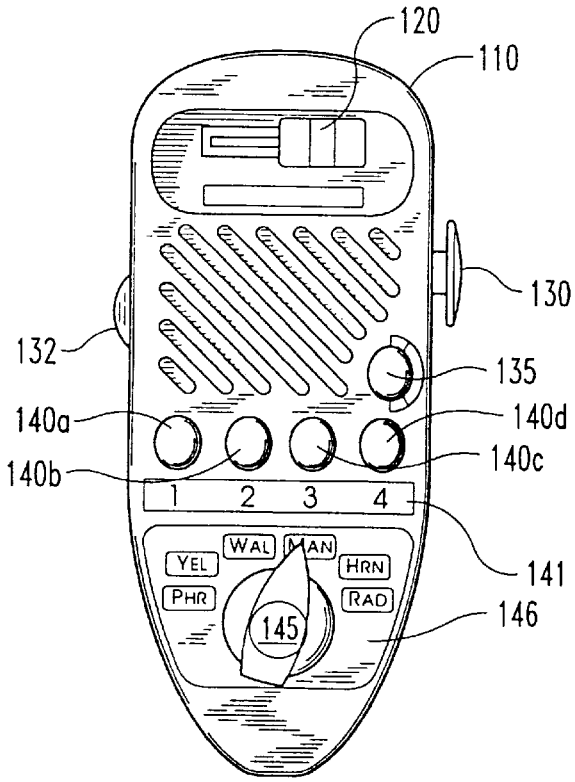
FIG. 3B is a top plan view of the integrated handheld microphone and control device of FIG. 2.
Figure 3C:
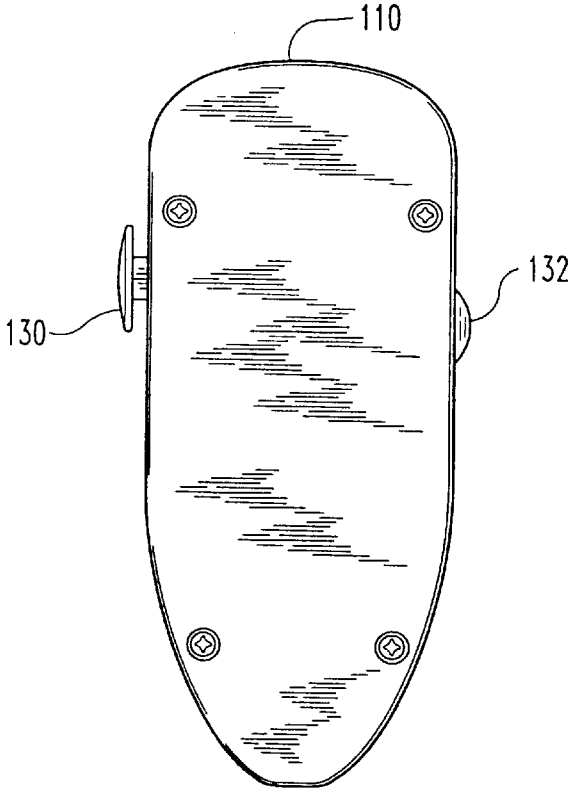
FIG. 3C is a bottom plan view of the integrated handheld microphone and control device of FIG. 2.
Figure 3D:
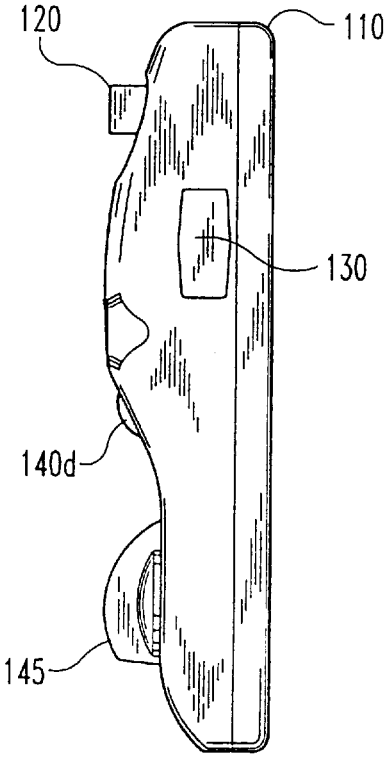
FIGS. 3D and 3E are side elevational views of the integrated handheld microphone and control device of FIG. 2.
Figure 3E:
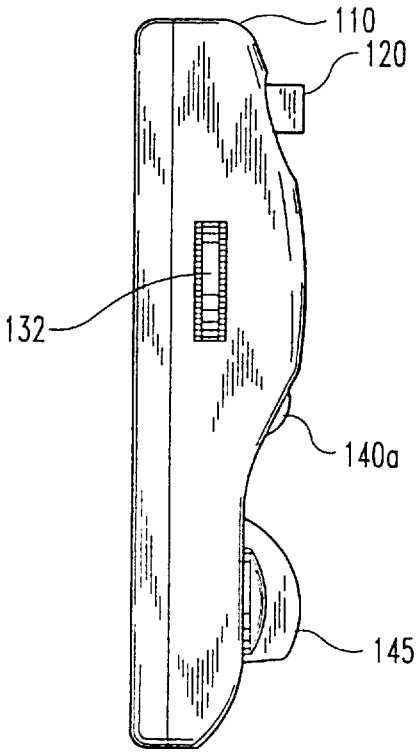
Figure 3F:
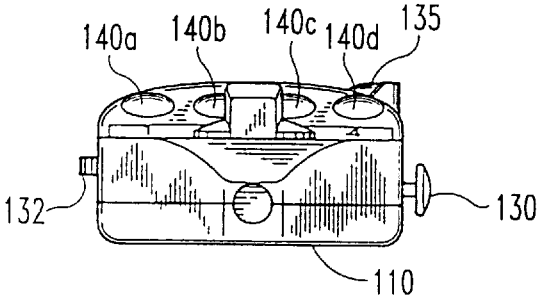
FIGS. 3F and 3G are end elevational views of the integrated handheld microphone and control device of FIG. 2.
Figure 3G:
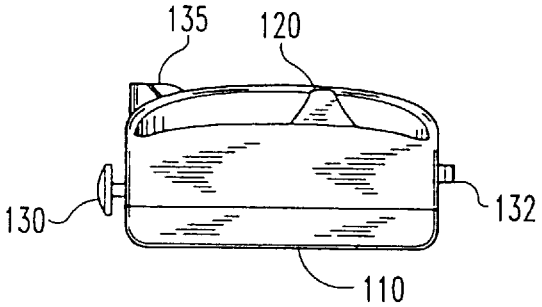

Referring now to FIG. 2, there is shown a perspective view of an electronic siren system 100 including an integrated handheld microphone and control handle 110 and a receiver box 400 in accordance with one preferred embodiment of the present invention. The integrated handheld microphone and control handle or control handle 110 incorporates microphone, siren function, emergency light control, and auxiliary functions all in a portable handheld unit. The unit is designed to be compact enough to be held in the hand of a user while operating a vehicle, as well as to be small enough to be mounted anywhere in the vehicle at the occupant's convenience for ease of use. For example, the control handle 110 may be surface mounted to the vehicle dash, console or seat using hook and loop type fasteners, such as VELCRO® made by 3M.

The electronic siren system 100 is designed to produce audible tones through a speaker (265 of FIG. 6) and control alerting devices to warn of approaching emergency vehicles. The control handle 110, similar in shape to a microphone, contains all controls normally present at the control head, except radio volume, which is located on the siren board. Thus, the control handle 110, through its handheld control will control and select tones, allow the occupant to talk through the speaker, select emergency light functions, and select auxiliary functions such as "alley" lights, gun locks, etc.

Further, electronic siren system 100 includes a receiver/amplifier box 400, comprising a siren box portion 200 and a relay box portion 300. Receiver/amplifier box 400 is connected to the control handle 110 via a standard four conductor shielded microphone cable connector 150. The siren box and relay box are integrated into a single unit which may be located in the trunk or under the seat of the emergency vehicle. Thus, the control handle 110 may be remote from the bulkier receiver/amplifier box 400, freeing up more usable room in the vehicle. The siren box 200 of the present embodiment includes siren board circuitry for controlling the generation of siren tones, the control of the amplifier, and thus the speaker, and light bar controls. The relay box portion 300 is designed to provide fused over-current protection power control to the siren box 200 and control handle 110. Fuses 310*a*–310*h* of the relay box 300 are externally accessible, instead of internally mounted as in previous electronic siren systems, so as to provide greater convenience when changing the fuses.

Additionally, connector block 305 permits connection of external devices to the receiver/amplifier box through the fuses 310*a*–310*h*. Auxiliary function control wires are secured in the separate ports of the connector block 305 using set screws, such as set screw 320. Seven individual connector ports are shown as part of connector block 305, however fewer or greater number of ports may be included depending on the number of external auxiliary devices to be controlled. Correspondingly, each connector port is associated with one of the fuses 310*a*–310*g*. Fuse 310*h* is connected between the +12 V vehicle power supply and the siren board, so as to provide over-current protection for the siren board. The relay box circuitry, as well as the siren board, will be discussed more fully in connection with FIGS. 7–9, herebelow.

FIGS. 3A–3G are additional views of the control handle 110 of one embodiment of the present invention. Control handle 110 includes a slide switch 120, a siren/override button 135, auxiliary function buttons 140*a*–140*d* and a rotary function switch 145. Further, a push-to-talk or PTT button 130 is located on one side of the control handle 110 and a rotating volume control switch 132 is located on the opposite side. A microphone element (131 of FIG. 7) is mounted internally beneath the sound holes 115. The control handle 110 may be picked up like a microphone to operate in the P.A. mode. The handheld control unit 110 may be made of any suitable material, but is preferably made from molded plastic.

Slide switch 120 may be of any kind of slide switch known. However, due to the risk of failure of contact type switches, in the preferred embodiment of the present invention, a contactless switch is used as the slide switch 120. Most preferably an optical switch or Hall effect switch may be used as the slide switch 120.

The slide switch 120 is a four position progressive slide switch used to control the state of auxiliary outputs L1, L2 and L3 (FIG. 5 and FIG. 9) of the electronic siren system. Typically, the outputs L1, L2 and L3 will be connected to various warning light circuits of the vehicle. In the first or "off" position, (slide switch 120 is all the way to the left of the slide) no signal is sent out via outputs L1, L2 or L3. When the slide switch 120 is moved to a second or "L1" position, the L1 output is powered and the device(s) connected to the L1 output is activated. Likewise, when the slide switch 120 is moved to the third or "L2" position, both the L1 output and the L2 output are powered, and the devices connected to those outputs would be activated. Further, with the slide switch 120 in the fourth or "L3" position, the L1, L2 and L3 outputs are powered and the devices connected to those outputs are activated.

In the preferred embodiment, each of the outputs L1, L2 and L3 are connected to a warning light circuit. When slide switch 120 is in the off position, the vehicle's warning lights are off and the horn ring blows the horn. When the slide switch 120 is in the "L1" position, one warning light circuit is on and the horn ring still blows the horn. When the slide switch 120 is moved to its third position both the first and second warning light circuits are on (outputs L1+L2 are energized) and the horn ring is still used only to blow the horn.

In one preferred embodiment of the present invention, when the slide switch 120 is moved to the "L3" position, a special "L3" default mode is activated. Upon first entering the "L3" position, first, second and third warning light circuits are activated (outputs L1+L2+L3 are energized) and the horn ring will activate the Yelp tone as a default setting regardless of the position of rotary function switch 145. The above operations, including the creation of the Yelp tones, is controlled by a microprocessor (U2 of FIG. 8A) located on the siren board.

Further, the "L3" default mode is also activated if slide switch 120 is in the "L3" position when power is first supplied to the control unit 110 (i.e. when the power switch at the control handle is turned on). In the "L3" default mode, the devices that are attached to L1, L2, L3 and the Yelp tone will all be active. Further, Airhorn override is available in this mode.

To deactivate the "L3" default mode the operator must either change the position of the function selector switch or activate the P.A. by pressing the PTT button 130. After which point, the tone currently selected by the rotary function switch 145 will be emitted by the siren and L1, L2 and L3 will be active until the slide switch is changed to another position. A second way to way to deactivate the "L3" default mode is to simply change the position of the slide switch to another position other than L3. Again, the tone that is currently selected by the function switch will be emitted by the siren. Use of the microprocessor (U2 of FIG. 8A) to control the "L3" default mode activation and deactivation permits the rapid deactivation of the "L3" default mode without interruption or complete shutdown of the siren and light controls.

Siren/override button 135 is used to manually activate the siren. This button 135 is provided for manual and override activation and performs the same or, optionally, a different function as the auxiliary input of the siren board. In the preferred embodiment, the siren button 135 provides control of the manual wail siren signal as an alternative to the use of the horn ring circuit whenever the rotary function switch 145 is in the Manual position, or when the slide switch 120 is in the "L3" position, once the siren is no longer in the "L3" default mode.

Figure 5:
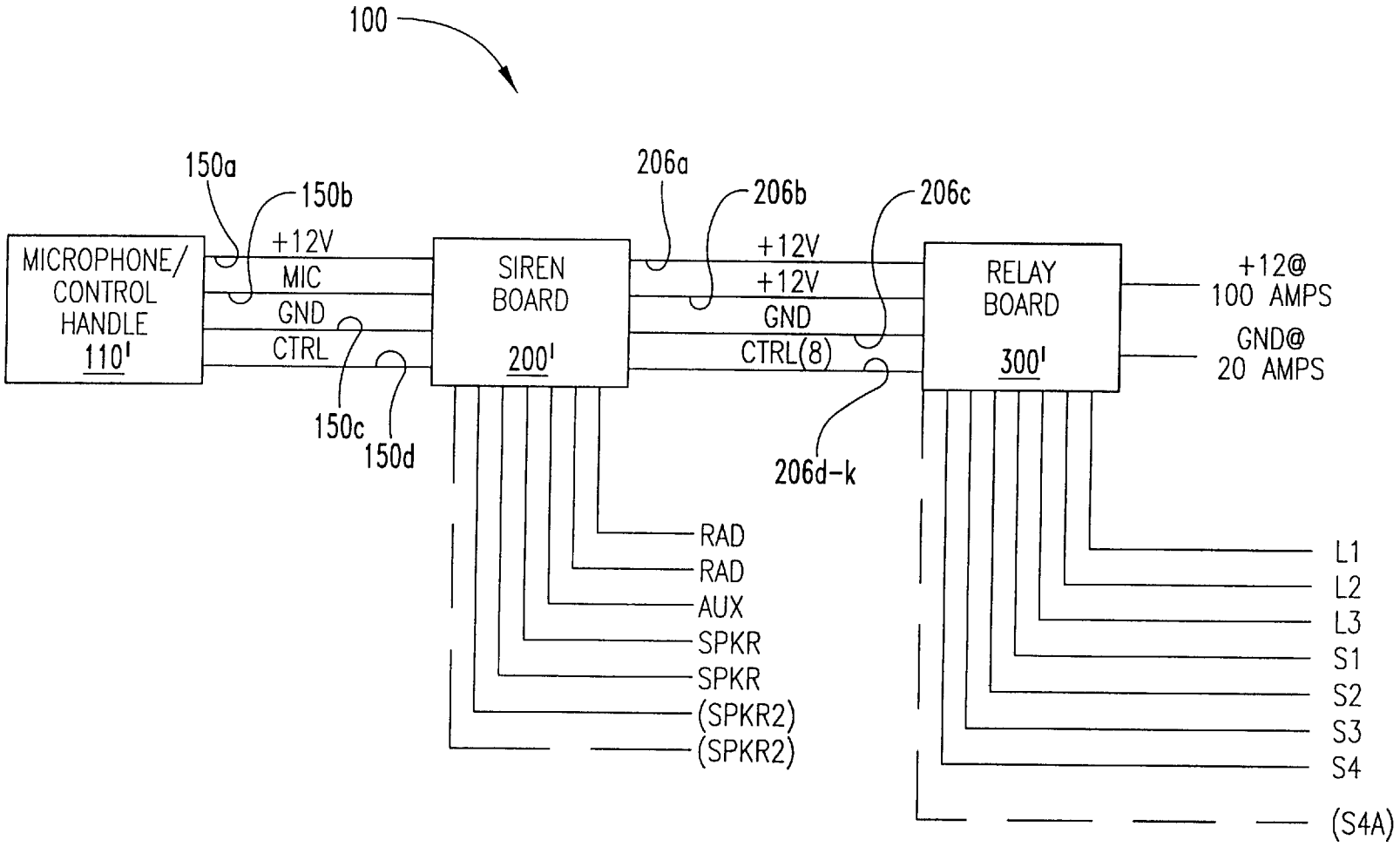
FIG. 5 is a block diagram of one preferred embodiment of the present invention.
Figure 9:
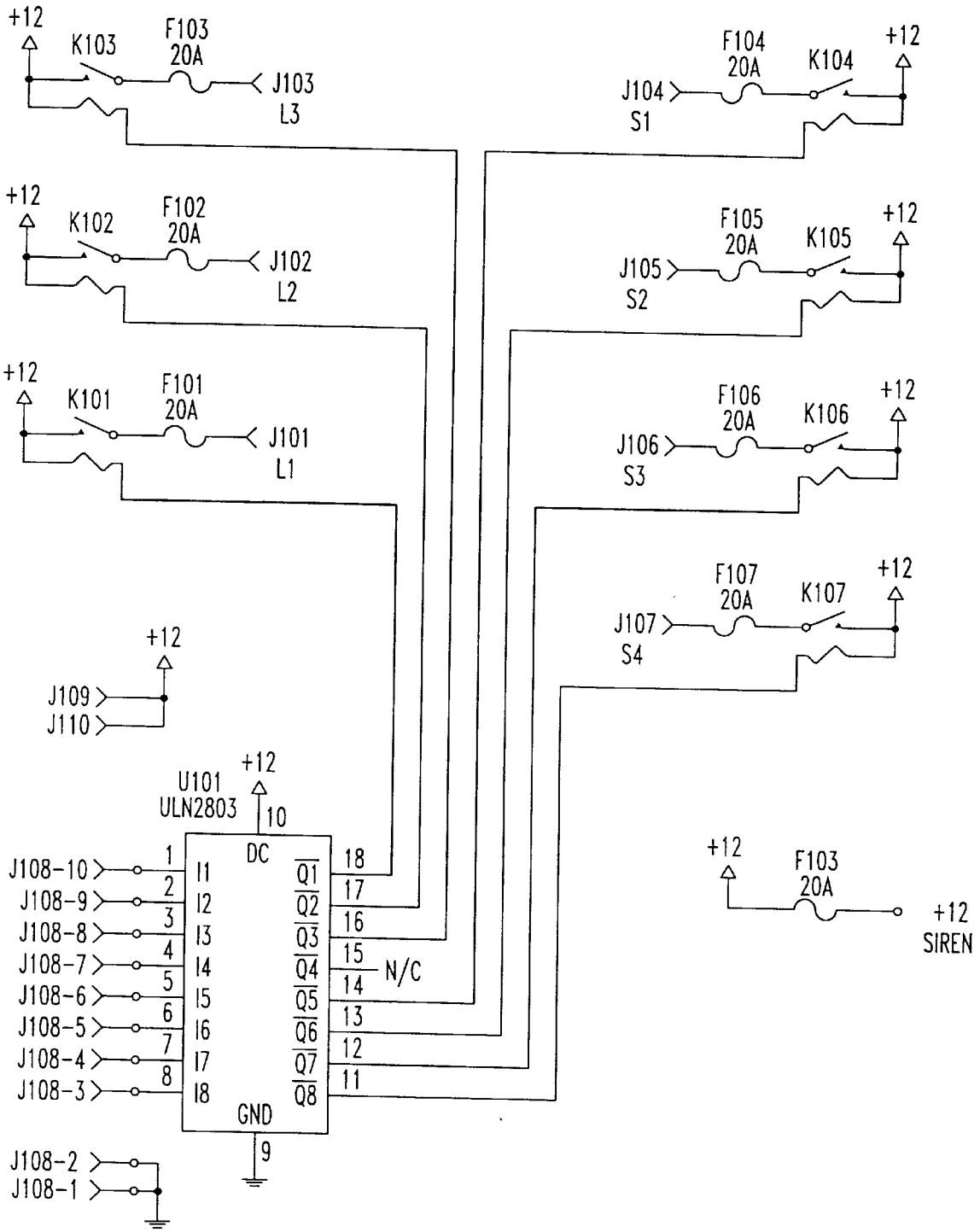
FIG. 9 is a circuit diagram of the relay board portion of the receiver box of one preferred embodiment of the present invention.

Auxiliary function buttons 140*a*–140*d* are used to control the corresponding output circuits on the relay board (S1–S4 of FIGS. 5 and 9). Optionally, auxiliary function button 140*d* may be used to activate outputs S4 and optional output S4A as an automatic alternating flashing output. Typical applications of these auxiliary function buttons include activation of auxiliary lights, alley lights, gun locks, trunk and door locks, etc. The control handle 110 includes a rotary function switch which is manually operable into a selected one of six positions to select from one of six available functions, which functions can include, among others, phaser, yelp, wail or hi-low sirens, a manually controlled siren, an airhorn sound, and a radio repeat function. Additionally, each function control, (i.e. slide switch, rotary switch and pushbutton) has a different type of feel associated with it so as to enable "feel" only operation of the siren apparatus.

Figure 4:
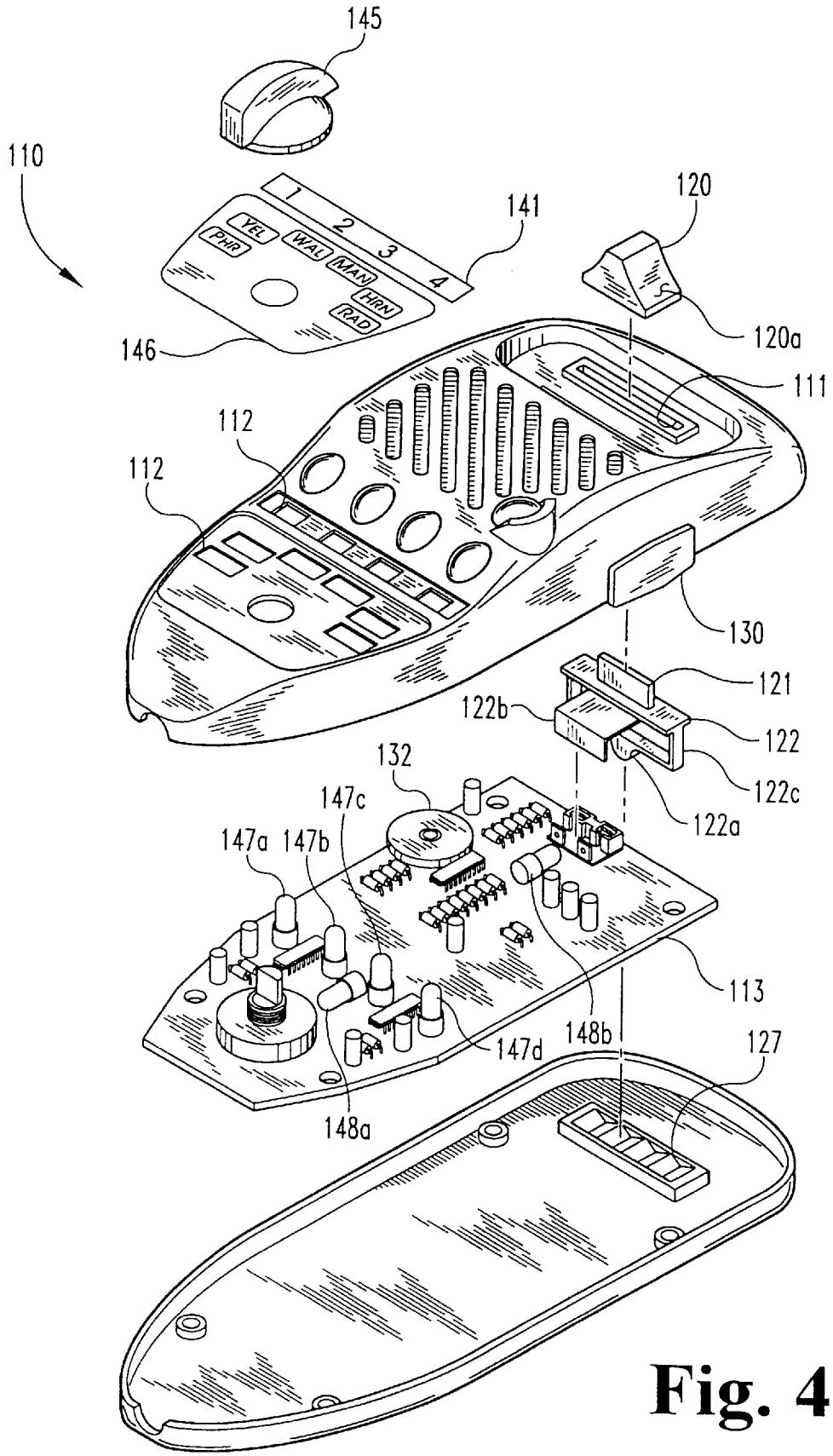
FIG. 4 is an exploded perspective view of the integrated handheld microphone and control device of FIG. 2.

Referring now to FIG. 4 there is shown an exploded view of the control handle 110 of FIGS. 2 and 3A–3G. Molded into the control handle 110 are a number of clearance holes 112. The control handle 110 is back-lit using the clearance holes around the control switches for a light flooding technique. Lamps 148*a* and 148*b* (L201 and L202 of FIG. 7) are lit for this purpose, when the control handle 110 is on. Further, LEDs 147*a*–147*d* are turned on when auxiliary function buttons 140*a*–140*d*, respectively, are activated.

Additionally, the control handle 110 may incorporate replaceable, adhesiveless, function nameplate panels 141 and 146. The function label may be inserted in to the control handle 110 by means of tabs and slots (not shown), thus allowing the user to easily remove and replace them with customized nameplates. The use of tabs and slots instead of adhesives eliminates the need for "sticky back" or "rub on" inserts or labels required for custom installations, and negates the need to partially disassemble the unit to change labels.

One feature of the preferred embodiment of the present invention is the contactless, optical slide switch 120. Slide switch 120 includes a knob portion 120*a* connected to a body portion 122 via the stem 121. The body portion 122 of the optical slide switch includes an integrally formed spring portion made up of spring arms 122*c* and projection 122*a* and a shield portion 122*b*. When control handle 110 is assembled, the stem 121 extends through the slide slot 111 of the control handle 110, and connects the knob 120*a* to the body portion 122. The projection 122*a* is seated in the grooved track 127 on the base plate of the control handle 110.

Grooved track 127 includes four valleys separated by three peaked portions. The spring arms 122*c* of the body portion 120 are springy enough to allow the projection to travel over the peak portions of the grooved track 127, into the next valley when the position of the slide switch 120 is changed. However, due to forces applied by the spring arms 122*c*, once the projection 122*a* is seated in a valley portion, it will be biased into remaining there until the switch position is manually changed by a user. Thus, the slide switch 120 may be locked into any one of four positions, each position corresponding to a valley along the grooved track 127.

Figure 4A:
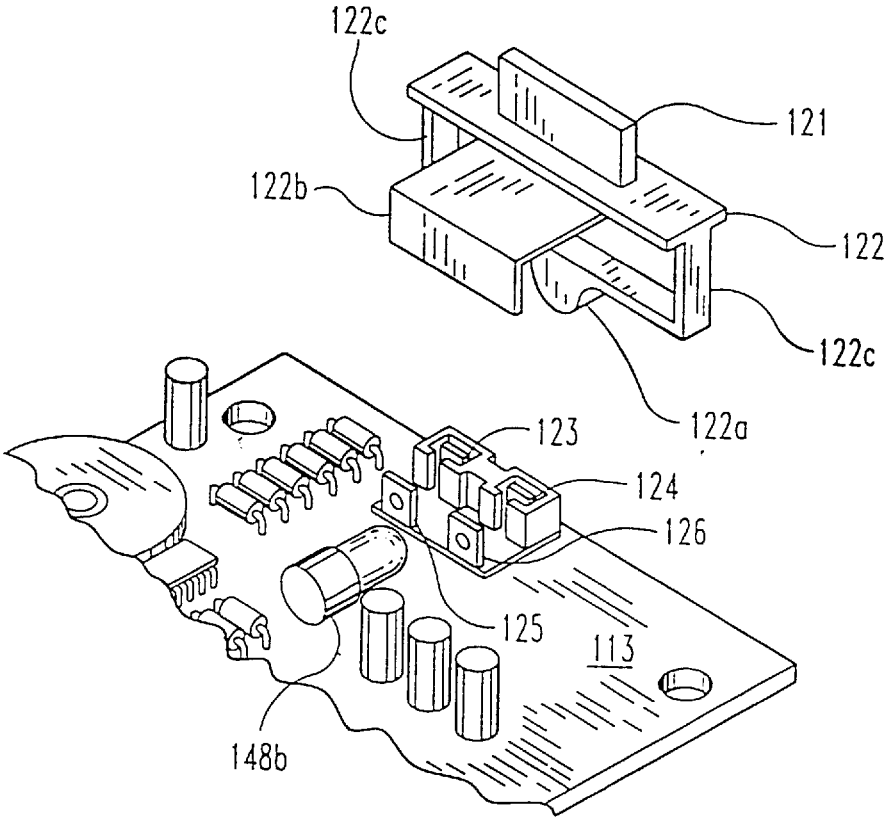
FIG. 4A is view of a portion of the integrated handheld microphone and control device shown in the exploded perspective view of FIG. 4.

Referring now to FIG. 4A, there is shown an enlarged partial view of the circuit board and a portion of the optical slide switch 120. LEDs 125 and 126 (D201 and D202 of FIG. 7) are mounted on the PC board 113 and are normally "on" when a voltage is supplied to the control handle 110. Phototransistors 123 and 124 (Q201 and Q202 of FIG. 7) are additionally mounted to the PC board 113 with their conductive bases directed towards the LEDs 125 and 126. The remaining portions of the phototransistors 123 and 124 are shielded to keep out stray light. When assembled and in the first position, the shield portion 122*b* of the slide switch 120 rests to the left of the LEDs 125 and 126 and the phototransistors 123 and 124, which are both conducting due to the incident energy from the LEDs 125 and 126. Additionally, the projection 122*a* rests in the first valley in the grooved track 127. This position corresponds to the "off" position described above. When the slide switch 120 is moved to the "L2" position, the projection 122*a* will be biased into the second valley in grooved track 127, and the shield portion 122*b* will obscure the phototransistor 123 from the LED 125. Thus, when the slide switch 120 is in the second or "L1" switch position, the phototransistor 123 is not conducting, while the phototransistor 124 is conducting.

Similarly, when the slide switch 120 is moved to the third or "L2" position, the shield portion 122*b* isolates both phototransistors 123 and 124 from the LEDs 125 and 126. Thus in the "L2" switch position, both phototransistors are turned "off". Additionally, the projection 122*a* is biased into the third valley of the grooved track 127.

Finally, when the slide switch 120 is in the "L3" position, the projection 122*a* is biased into the final valley of the grooved track 127, and cannot be moved any further to the right. The shield portion 122*b* now isolates only the phototransistor 124 from the LED 126, thus permitting the phototransistor 123 to be conducting, while the phototransistor 124 is turned "off". As can be seen, each position of slide switch 120 has a unique binary representation due to the state of the phototransistors. These states are shown herebelow in Table 1.

TABLE 1

| POSITION | PHOTOTRANSISTOR 123 | PHOTOTRANSISTOR 124 |
|---|---|---|
| OFF | ON | ON |
| L1 | OFF | ON |
| L2 | OFF | OFF |
| L3 | ON | OFF |

Optionally, a Hall effect switch having the same logic table as shown in Table 1 may be used in place of the optical slide switch 120.

Figure 6:
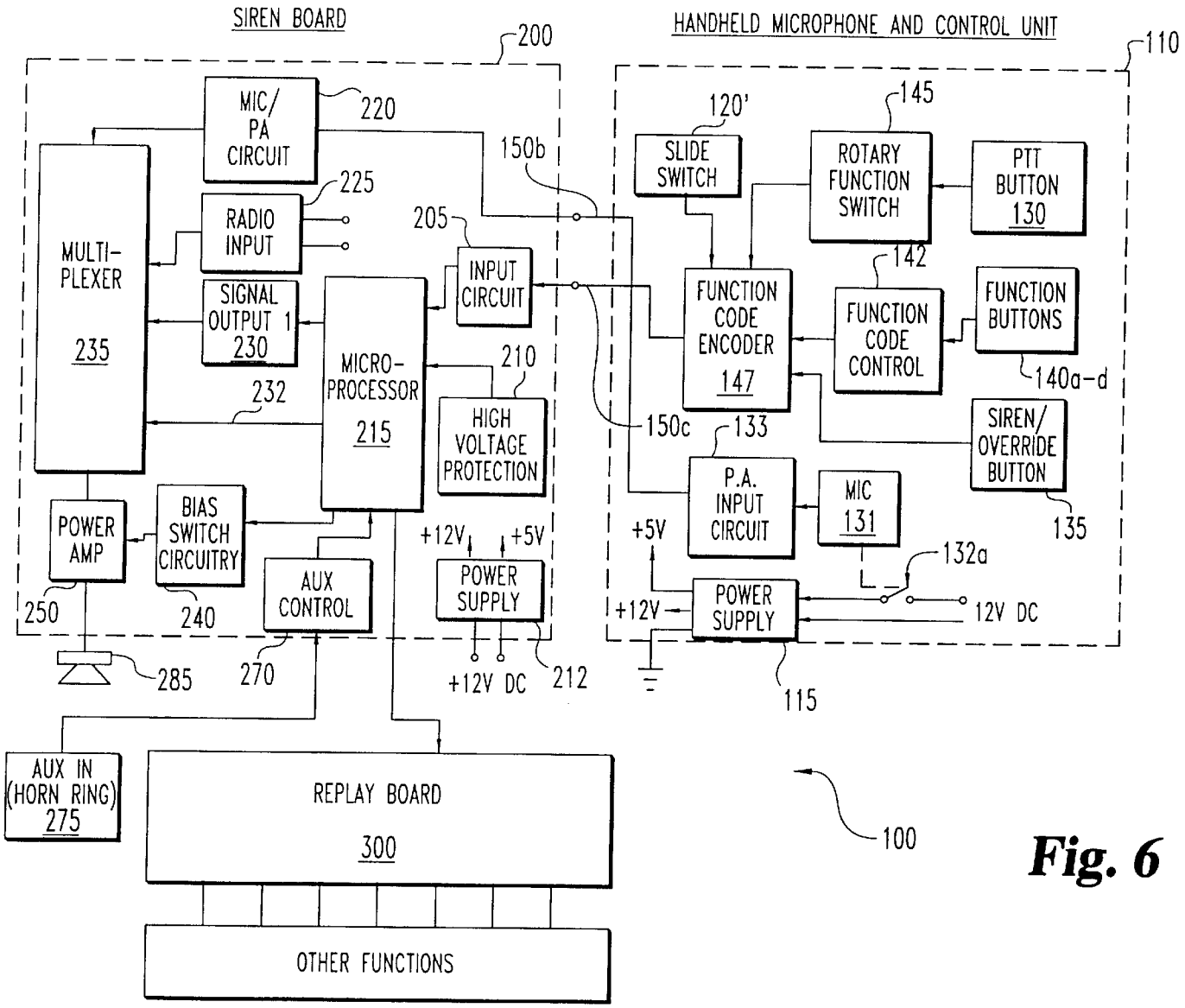
FIG. 6 is a further defined block diagram of another preferred embodiment of the present invention.

Referring more particularly to FIGS. 2, 5 and 6, there is shown an electronic siren system in accordance with one embodiment of the present invention. As described above, the electronic siren system 100 of the present invention is a two piece unit consisting of the control handle 110 and the receiver box 400. The receiver box 400 is composed of a siren board 200' and a relay board 300' housed in a common case. The receiver box case is designed on a "building block" principal to bring the quantity of mounting hardware to a minimum, thus reducing overall product material and labor cost. The siren board contains a microprocessor 215 to perform all decoding, control and tone generation functions, a single 200 Watt amplifier, and voltage regulation circuits. A second siren board may be developed to provide two independent amplifiers in dual siren operation in accordance with the teachings of the commonly assigned patent application Ser. No. 08/104,986 entitled AN ELECTRONIC DUAL SIREN APPARATUS AND METHOD FOR USING SAME, that application incorporated herein by reference in its entirety. If a second siren board is incorporated, an optional second speaker may be connected to the siren board circuit 200', as indicated in FIG. 5.

As described in connection with FIGS. 2 and 9, the relay board 300' contains seven fused power relay circuits, although an optional eighth fused relay circuit for alternate flash configuration may be added. The relay board 300' additionally provides the fused power input to the siren board 200'. The relay circuits are controlled by the microprocessor 215 located on the siren board 200'.

Referring more particularly to the block diagrams of FIGS. 5 and 6, as stated above, the microphone and control handle 110 is connected to the siren board 200', via a four conductor shielded cable 150. Conductor 150*a* supplies a +12 V power source from the siren board 200' to the microphone and control handle 110. Conductor 150*b* is a microphone line leading directly from the microphone/P.A. circuitry of the control handle 110 to the microphone/PA circuit in the siren board 200'. As described in connection with U.S. Pat. No. 4,646,063, previously incorporated herein by reference, a single control line 150*d* relays signals from the control handle 110 to the siren board 200'. Further, conductor 150*c* is the cable shield, which is tied to ground.

The siren board 200' contains the circuitry essential for producing the various siren tones, as well as for controlling auxiliary devices. As shown in FIG. 5, the siren board 200 is connected via conductors to the police radio so as to receive inputs from and/or transmit outputs to the radio. The siren board is additionally connected via a conductor to an auxiliary device, such as the horn ring circuit of the vehicle. A power amplifier 250 of the siren board 200' is connected to an externally mounted speaker 265 via the external speaker wires. As noted above, a second siren board including a second amplifier may be used with the electronic siren 100 so as to produce a dual (possibly out of phase) siren output, as disclosed in the commonly assigned co-pending U.S. patent application Ser. No. 08/104,986. The siren board 200' would provide an output to the second speaker via optional speaker wires.

The siren board 200' is additionally connected to the relay board 300'. One purpose for having relay board 300' is to be able to control auxiliary devices from the control handle 110, via the siren board 200'. Additionally, the relay board protects the auxiliary devices from overcurrent conditions via externally mounted fuses 310. The fuses 310 are externally mounted, and not internally soldered as in some past devices, so as to provide easy access to the fuses in case one needs to be replaced.

The relay board 300' is connected to the siren board 200' via two conductors 206*a* and 206*b*, which both supply +12 V from the relay board to the siren board, a ground conductor 206*c*, and eight control lines 206*d*–206*k*. Further, the relay board 300 includes eight output conductors, L1–L3, and S1–S4A. Conductors L1, L2 and L3 are chosen to supply output signals to various output devices based on the position of the slide switch 120 on the control handle 110, as described above.

Conductors S1, S2, S3, S4 and (optionally) S4A, are used to enable additional auxiliary device functions from the control handle 110. These auxiliary device functions could include activating the gun lock, trunk lock, alley lights or spotlights, at the discretion of the person programming the unit.

Figure 7:
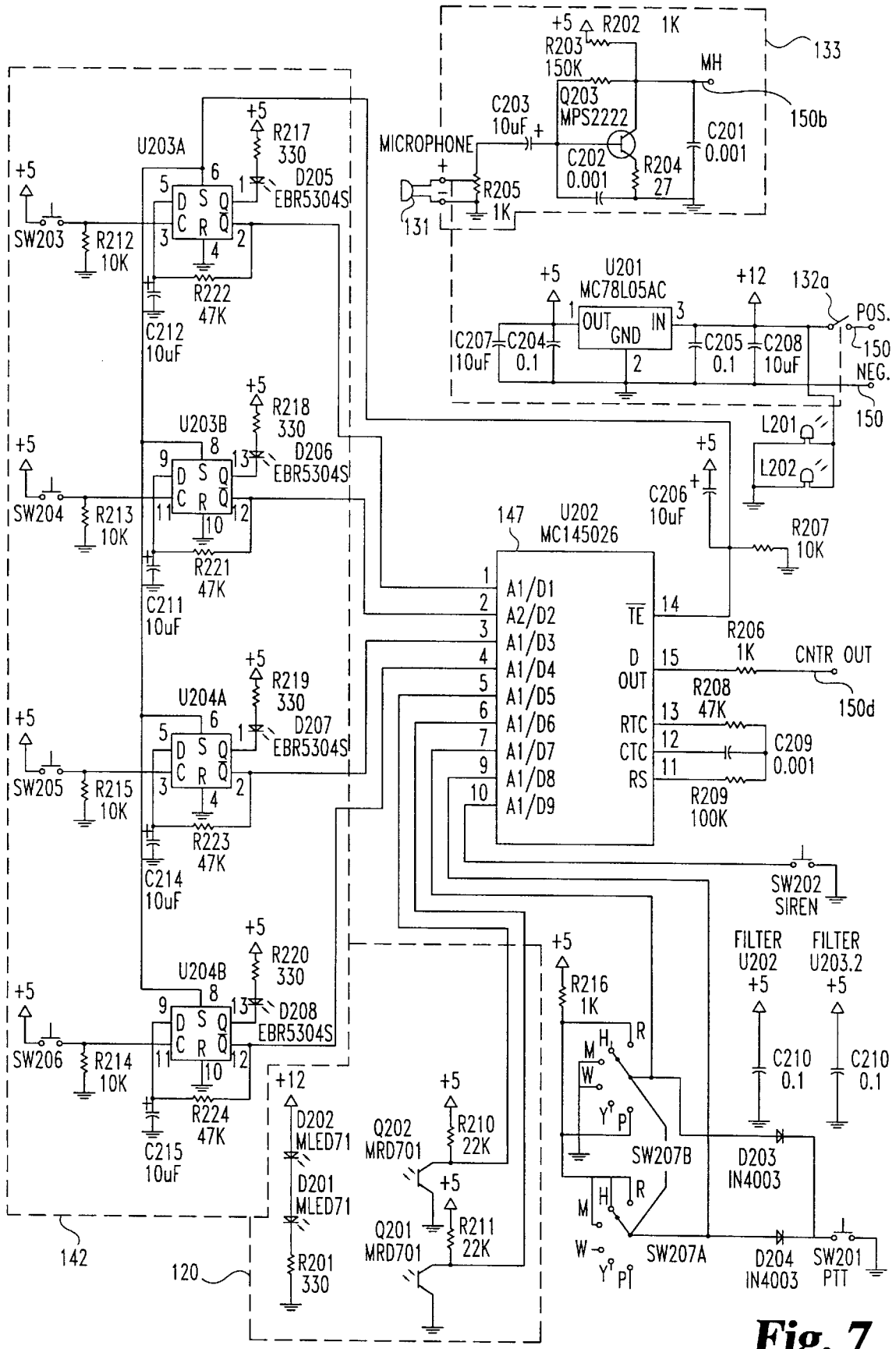
FIG. 7 is a circuit diagram of the microphone and control unit portion of one preferred embodiment of the present invention.

In FIGS. 6 and 7 there are shown block and circuit diagrams, respectively, of the handheld microphone and control unit 110 of the present embodiment. Referring now to FIGS. 6 and 7, the operation of the handheld microphone and control unit 110 will be described herebelow.

MICROPHONE AND CONTROL HANDLE CIRCUITRY

Referring now to FIG. 7, there is shown the handle circuit 110' for the microphone and control handle circuit 110 of FIG. 6. Unless otherwise specified, the values of all capacitors in FIGS. are in microfarads and all resistors are in Ohms. The handle circuit 110' includes its own internal regulated power supply 115 including input terminals 105*a* and 105*c*, which are connected to receive the +12 V source and ground from the siren board via conductors J2-2 and J2-SHLD (FIG. 8B) and produce a +5 V filtered output. The input voltage from the receiver is filtered via capacitors C205 and C208 and applied to the input (pin 3) of the integrated circuit voltage regulator U201. The output of voltage regulator U201 appears at pin 1 of the voltage regulator U201, where it is filtered by capacitors C204 and C207, as a regulated +5 V D.C. voltage source. This filtered +5 V source is used to power all portions of the handle circuit 110'.

Side rotating volume control switch 132, includes the power switch 132, as well as the volume potentiometer R205 of the P.A. input circuit 133. The power switch 132*a* is used to connect the input of the power supply 115 to the source voltage at the receiver box. The volume potentiometer R205 is used to adjust the volume of the P.A. system. Lamps L201 and L202 are turned on when the power switch 132*a* is closed, to indicate that power is being supplied to the handle 110, as well as to provide backlighting for certain portions of the handle. The regulated voltage supply U201 may be a standard +5 V regulator IC such as the MC78L05AC made by MOTOROLA.

Rotary function switch SW207, which corresponds to the rotary function switch 145 of FIG. 6, is provided with a common rotor terminal which is in contact to two isolated switch segments SW207A and SW207B. Switch SW207, in this first preferred embodiment is a six position switch having selectable output contacts "R", "H", "M", "W", "Y" and "P". Individual ones of the terminals "R" through "P" are designated for production of the various siren functions, "R"adio repeat, "H"orn, "M"anual, "W"ail, "Y"elp, and "P"haser, respectively. Terminals "R", "H", "M", "W", "Y" and "P" are connected in various configurations so that the binary input to pins 7 and 9 of encoder U202 (127 of FIG. 6) are unique for each of the six rotary switch positions. For example, when the rotary switch 207 is turned to the radio repeat mode, both inputs to pins 7 and 9 are high, as the radio repeat pole "R" in both switch segments SW207A and B are connected to the 5 V supply. Likewise, when switch SW207 is in contact with the Wail mode pole "W", the SW207A contact is low, while the SW207B contact is floating.

Further, when it is desired to utilize the invention as a P.A. device, it is necessary to disable the rotary switch SW207, so that no attempt to transmit a siren control code over the control line D_OUT can be made. This is accomplished by depressing the push-to-talk button 130, thus closing switch SW201, which brings the output of both segments of the rotary switch SW207 low and disables the siren by pulling the outputs of both switch segments to ground.

Table 2 is provided to show the unique combination of pin outs to encoder pins 7 and 9.

TABLE 2

| FUNCTION | PIN 7 (SW207A) | PIN 9 (SW207B) |
|---|---|---|
| RADIO REPEAT | HIGH | HIGH |
| HORN | FLOATING | HIGH |
| MANUAL | LOW | HIGH |
| WAIL | LOW | FLOATING |
| YELP | FLOATING | FLOATING |
| PHASER | HIGH | FLOATING |
| P.A./MIC (PTT) | LOW | LOW |

As can be seen each rotary switch position provides a unique code to the encoder U202 via pins 7 and 9.

Actuation of any of the auxiliary function buttons 140*a–d* of the control handle 110 closes a corresponding one of momentary switches SW203–SW206, respectively, and activates the function code control circuitry 142. When each momentary switch is closed, a logic high pulse, due to the connection of the pole of the switch to the +5 V supply, is present at the clock input C of a D-type flip-flop. The D-type flip-flops of the present embodiment are configured so as to toggle with each pulse at the clock input C, causing the states of the Q and $\overline{Q}$ outputs to change. By connecting the $\overline{Q}$ output back to the D input, D becomes whatever $\overline{Q}$ is after the clock pulse. A 10K resistor, such as resistors R212, R213, R2124 and R215, is used to maintain the clock input at a logic low until the switch is pressed. Additionally, a 10 $\mu$F capacitor C206 and a 10K resistor R207 are connected to the set input (S) of each D-type flip-flop. Capacitor C206 and resistor R207 provide a reset pulse to the flip-flop upon power-up of the handle 110. The reset (R) input is grounded to provide the proper reset state.

Further, a 10 $\mu$F capacitor, such as C215, and a 47K resistor, such as R224 are connected to each flip-flop so as to provide switch debounce circuitry for the flip-flop. Thus, when one of the momentary switches SW203–SW206 is depressed, the flip-flop is toggled, wherein $\overline{Q}$ goes high, thus sending a high input to the corresponding input pin (pins 1–4, for flip-flops U203–U206, respectively) of encoder U202. Correspondingly, output Q of the flip-flop will go low, thus turning on the LED connected to the output Q.

In one particular example, if an operator desires to turn on the alley lights of the vehicle, and the alley light button on the handle 110 is button 140*a* of FIG. 2 which corresponds to SW203 of FIG. 7, the vehicle operator would depress button 140*a*. This action closes the switch SW203, which changes the state of the flip-flop U203A, thus causing the output to the encoder T202 to go high, and additionally lighting the LED D205. The flip-flop will remain in this state until the momentary switch SW203 is again closed by depressing button 140*a*. The remaining flip-flops U203B, U204A and U204B operate in the same manner. D-type flip-flops U203A, U203B, U204A and U204B may be implemented using two dual D-type flip-flop IC's such as the MC14013 made by MOTOROLA.

The phototransistors Q201 and Q202, in combination with LEDs D201 and D202, make up the optical slide switch circuitry 120' discussed herein more fully in connection with FIG. 4A. The collectors of the two phototransistors Q201 and Q202 are connected to pins 6 and 5, respectively, of the encoder U202. When the slide portion of slide switch 120 (FIG. 4) is in a first position, both phototransistors will be conducting, and the output to the pins 5 and 6 of the encoder U202 will be low. When the optical slide switch is moved to position "L1", so as to enable the first warning light circuit, phototransistor Q202 is obscured from LED D202, and the signal to pin 5 is high, whereas, the signal to pin 6 from phototransistor Q201 remains low.

Likewise, when the slide switch is moved to position "L2" in order to enable both the first and second warning lights, both phototransistors Q201 and Q202 are obscured from LEDs D201 and D202 and the inputs to pins 5 and 6 of the encoder U202 are both high. Finally, if the slide switch is moved to position "L3", so as to enable first, second and third warning light circuits, as well as the siren, then only phototransistor Q201 is obscured from the LEDs D201 and D202, and the input to the encoder U202 on pin 5 is low, whereas the input on pin 6 is high. The states of these inputs are described more fully in connection with FIGS. 4 and 4A. The siren/override button 135 is provided, as described above, for manual and override siren activation. Depression of the siren button 135 will close the momentary switch SW202, which is connected to input pin 10 to encoder U202. Upon depressing button 135, momentary switch SW202 brings the input at pin 10 to ground level (low).

Figure 10:
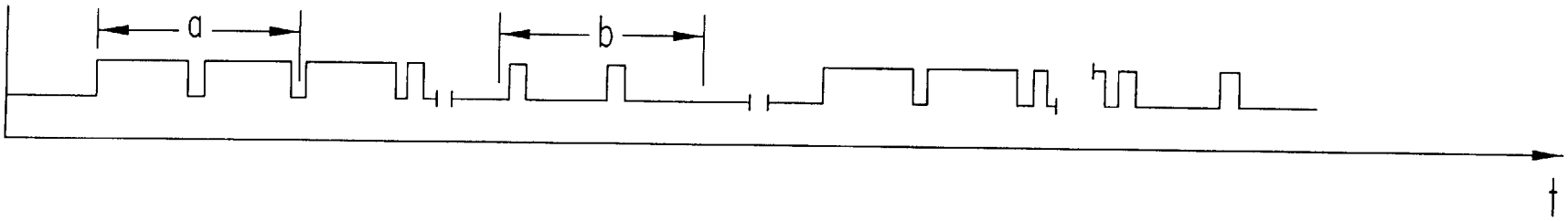
FIG. 10 is a diagram showing the output of the encoder of the circuit of FIG. 7.

Thus, as can be seen herein, activation of any of the buttons or switches on the handheld microphone and control unit 110 will relay information relating to the state of any particular control function to the encoder U202. Encoder U202 is a 9-input/1-output encoder and in the preferred embodiment may be the MC145026 9-input trinary encoder made by MOTOROLA. All nine input pins of the present encoder U202 are used as data lines. The output from encoder U202 at D_OUT (pin 15) is a serial representation of the parallel data received at the inputs of encoder U202. This data is serially transmitted to the siren board circuit 200' in the receiver box via the control line 150*c*. A representation of the serial data transmitted from the encoder U202 to the siren board is shown in FIG. 10. In this manner various control inputs indicative of functions requested by the vehicle operator are transmitted from the control handle 110 to the siren board 200'.

The encoder U202 includes a resistor/capacitor network comprising capacitor C209 and resistors R209 and R209, connected to condition an internal clock oscillator of the encoder U202. Also, encoder U202 includes a power pin connected to the +5 V regulated power supply (not shown) and a ground level pin connected to ground (additionally not shown).

Input terminal TE (pin 14) of the encoder U202 is an enabling input. When this input is high (2.5 volts or higher or a logic "1") the circuit is disabled. When this pin goes low (below 2.5 volts or a logic "0") the circuit is enabled and commences operation. To insure that encoder U202 will have adequate time to stabilize, the enabling input TE is connected to the +5 V regulated supply across a capacitor C206, the opposite terminal of which is connected through resistor R207 to ground. Accordingly, when the power switch is turned on, the +5 V supply is applied to the enabling input TE maintaining the encoder inactive. As this voltage disappears, as a result of charging of capacitor C206, the disabling signal at the enabling input TE eventually reaches what is effectively a logic "0" (or low) state and the encoder commences to operate.

When the encoder U202 has been appropriately activated (the input at pin 14 is low), it will produce a sequentially occurring, serial coded pulse signal or pulse train at its output terminal D_OUT (pin 15) which corresponds to or is otherwise determined by parallel trinary coded function switch signal applied to its data terminals D1–D9. This serialized binary coded output signal or pulse train is illustrated diagrammatically in FIG. 10. Each bit is represented by pulses as shown in the waveform in FIG. 10, which may be decoded either "high" or "low". The short pulses are timing signals and do not register as data bits.

Simultaneously, closure of PTT switch SW201 connects the microphone, a dynamic noise-canceling microphone in the working embodiment, through volume potentiometer R1' to a capacitor C203 through which the signal is passed to the base of transistor Q203. Transistor Q203 functions as a pre-amplifier stage causing the signal from the microphone to have an 80 db output gain. The output from transistor Q203 is supplied directly to the siren board circuit 200', via the microphone line 150*b*, which is connected via connector J2-1 in the siren board circuit to the receiver.

SIREN BOARD CIRCUITRY

Referring now to FIGS. 6, 8A–8D, there is shown the siren board circuitry 200' for the preferred embodiment of the present invention. Control data from data line 150*c* is relayed to the input circuit 205 of the siren board 200' via input line J2-3. The input circuit 205 includes an operational amplifier U4. When the control signal indicates a siren signal and/or light bar activity, the binary coded signal will appear at the inverting input to the Op Amp U4 as a series of +5 V pulses. The op amp U4 will function as an amplifier and an inverter, thereby producing an inverted signal resulting in restoration of the control signal. The recovered control signal is applied to an input terminal of port PA7 of the microprocessor U2.

Additionally, an audio signal received over MIC/P.A. line J2-1 from the handle circuitry 110' will be filtered and sent to input Y2 of the multiplexer U3, via the MIC_IN/P.A. line.

The microprocessor circuitry 215 of the present invention incorporates an 8-bit microprocessor U2 such as the MC68HC711D3 high speed CMOS single-chip microcomputer unit (MCU) made by MOTOROLA. Operation of the microprocessor U2 is controlled by programming stored within memory located on the microprocessor chip. The programming of the microprocessor U2 will be discussed below and in connection with FIGS. 11–13.

Further, the microprocessor 215 is programmed to generate the varied frequency square wave siren output signals from designated output ports. All of the siren patterns are comprised of square wave signals having the frequency controlled and varied as a function of time. The output signal is coupled from the output terminals of the microprocessor to the power amplifier, via the signal input 230 and multiplexer 235. The signal from power amplifier 250 is used to drive the speaker or siren 265. In the present invention, the microprocessor created siren tones can be used to directly drive the amplifier without the need for additional signal conditioning or processing.

The microprocessor of the present invention may be programmed to create all of the standard types of siren tones common to frequency-variant, square-wave output sirens. Among these common types of siren tones are the "Wail", "Yelp", "Hi-Low" and "Manual" sirens. The form of such waveforms for such siren tones is well known in the art and can be found detailed in U.S. Pat. No. 4,980,837 to Nunn et al., or U.S. Pat. No. 4,189,718 to Carson, the disclosure of those patents being expressly incorporated by reference herein.

Figure 8A:
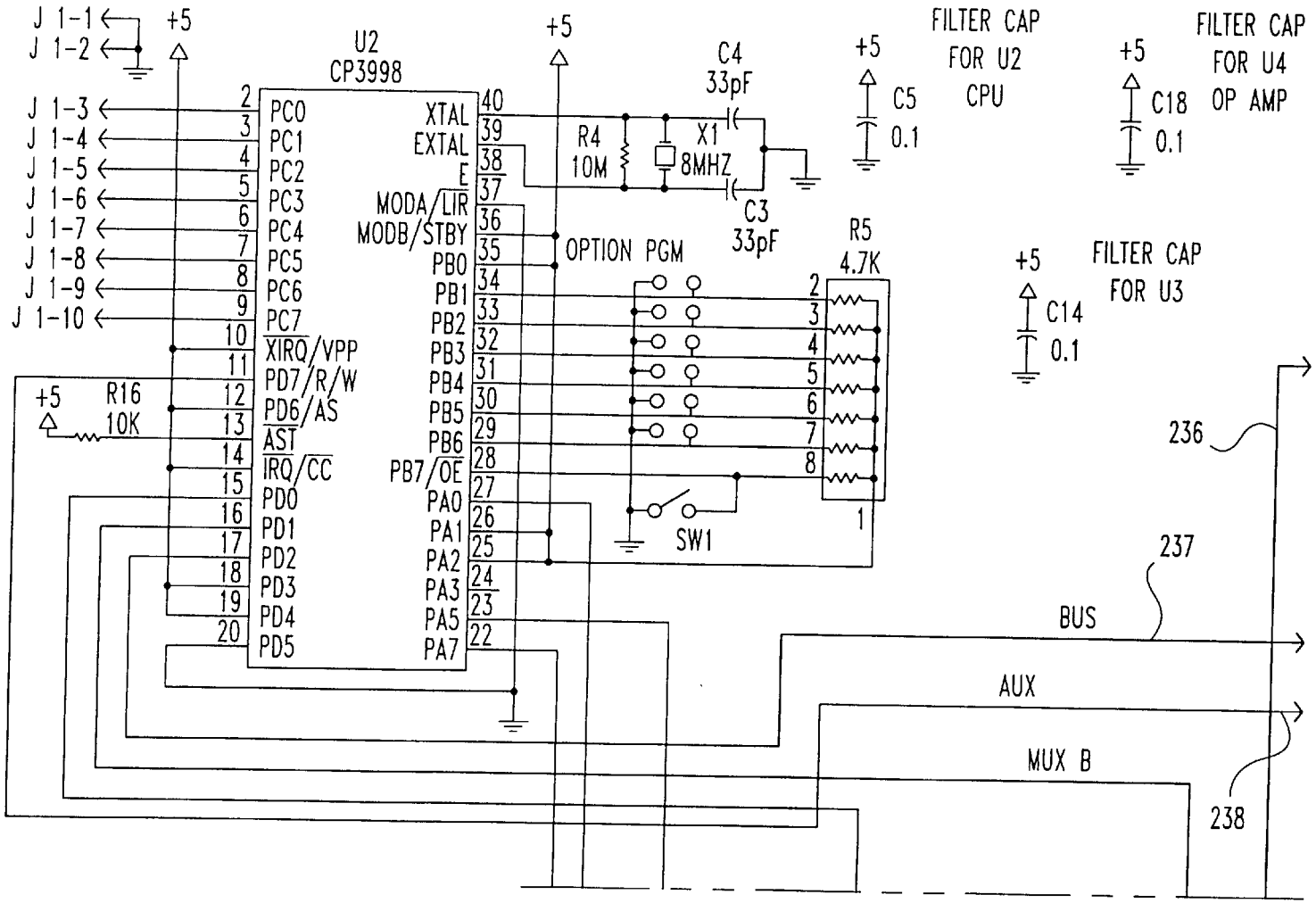
FIGS. 8A–8D are circuit diagrams of the siren board portion of the receiver box of one preferred embodiment of the present invention.
Figure 8B:
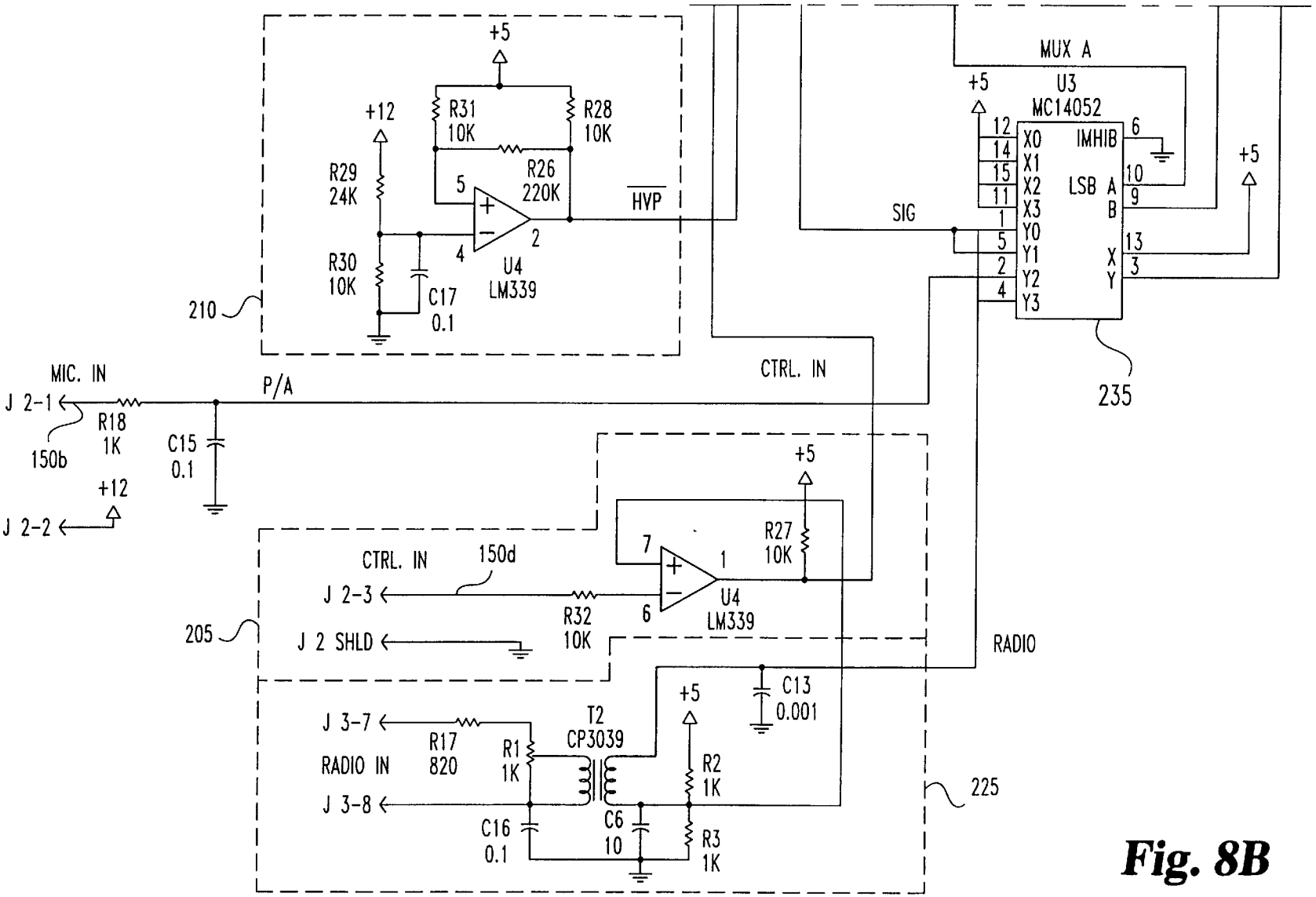
Figure 8C:
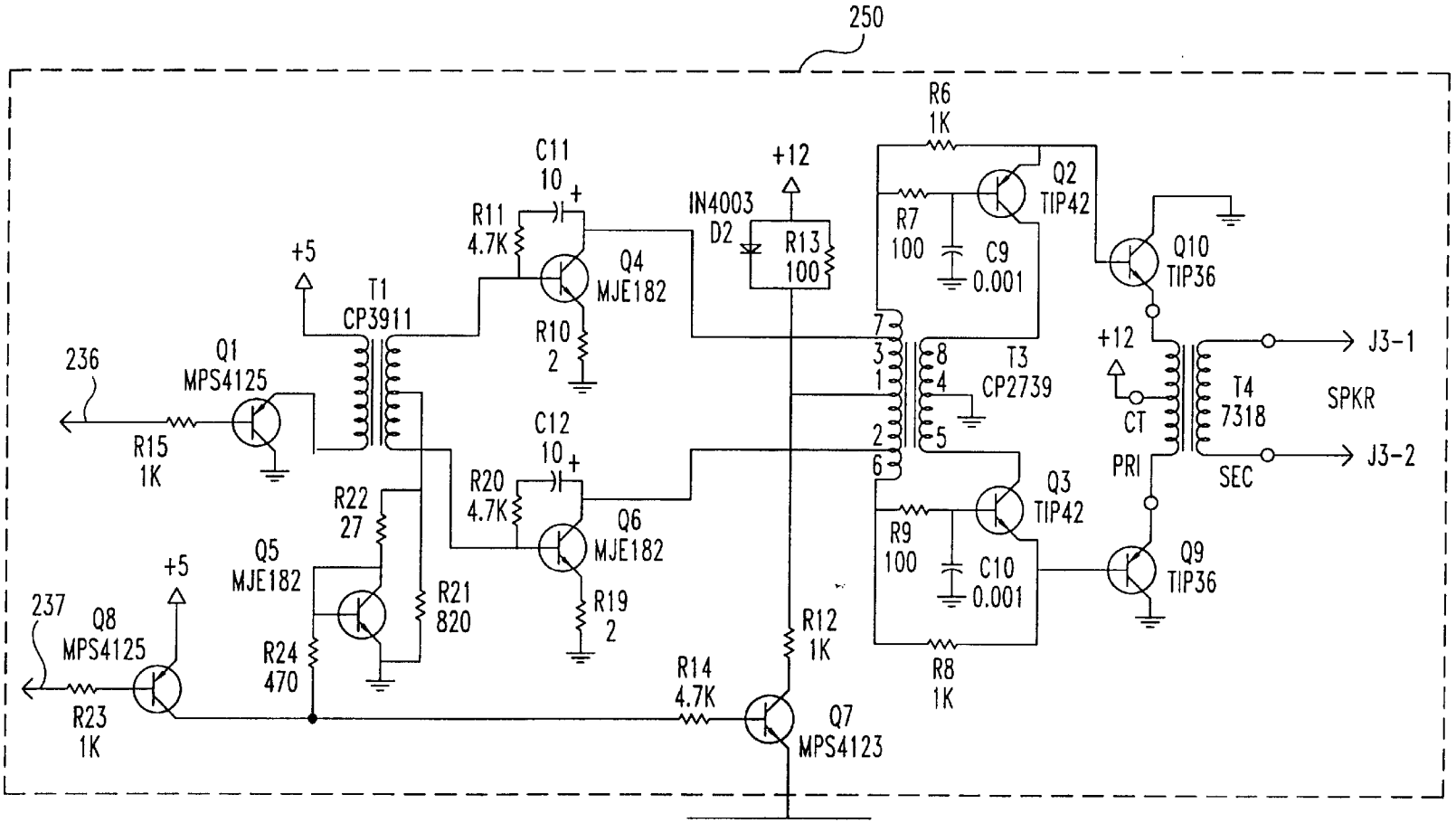

Included with the microprocessor U2 circuitry is an external crystal oscillator circuit comprising crystal X1, capacitors C3 and C4 and resistor R4 connected to pins 39 and 40 of the microprocessor chip as shown in FIG. 8*a*. This crystal oscillator circuit provides the timing for the microprocessor U2 and additionally provides the necessary timing involved in creating the different siren tones produced by the present invention. The microprocessor U2 additionally includes I/O ports PA0-7, PB0-7, PC0-7 and PD0-7. In the present working embodiment, all eight I/O terminals of port C (pins 2–9) are connected to corresponding inputs on the relay board, and will be discussed in connection with FIG. 9. Pin 21 (not shown) of the microprocessor U2 is connected to ground. Additionally, I/O ports PB1–PB7 (pins 28–34) are connected to pull-down resistor R5. To program the microprocessor for additional options, such as the tone cycle alternator mode described herein, it may be required to solder various resistor leads from resistor R5 to ground.

The microprocessor U2 is connected to the +5 V regulated power supply 212 through pin 1 (not shown), as are many of the pins including those controlling the external interrupts. The output from an auxiliary control circuit 270 is connected to pin 11, which controls the read/write input. Further, the external reset terminal (pin 13) is connected to the +5 V regulated power supply through the resistor R16.

The binary coded serial data is sent from the input circuit 205 to the microprocessor U2, via conductor or line, which is connected to I/O port PA7 of the microprocessor U2. Additionally, I/O port PA0 of the microprocessor U4 receives data from a high voltage protection circuit 210.

The high voltage protection circuit 210 produces a signal indicative of the voltage level of the vehicle power supply. The inverting input of an op-amp U4 is connected to the 12 volt terminal of the isolation power supply through a voltage divider comprising resistors R29 and R30. Capacitor C17 is connected between the inverting input of the op-amp U4 and ground and acts as a filter. The noninverting input of the op-amp U4 is connected to the +5 V regulated power supply via a voltage divider made up of resistors R26, R28 and R31. If the output of the high voltage protection circuit 210 appearing at input port PA0 is determined to be a value correlating to a logic "0", operation of the microprocessor U2 is interrupted.

Once the microprocessor U2 receives the serially encoded signal from the input circuit 205 through input port PA7, programming within the microprocessor interprets the data to determine the state of the flip-flops, slide switch and the rotary switch or PTT button at the microphone and control handle 110. The microprocessor U2 will use this information to bias the power amplifier circuit 250 into the desired mode of operation via output port PD2. Additionally, the microprocessor U2 will create the requested siren tones and output them via output ports PA5 to the multiplexer U3. Further, the microprocessor U2 will output signals via I/O ports PD0 and PD1 to the select lines A and B of the multiplexer U3 in order to choose the outputs of multiplexer U3.

One example of the operation of one working embodiment of the electronic siren apparatus is as follows. The reconstructed serial binary code sent to I/O port PA7 from the input circuit could be a request by the siren operator to produce a Wail type siren while simultaneously activating a first light bar circuit. The microprocessor U2 will interpret from the binary code that rotary switch terminal SW207A is floating, while SW207B is grounded, and that phototransistor Q202 is not conducting, while phototransistor Q201 is conducting. The microprocessor will recognize that the rotary switch 145 is set in the "W" or wail position, and further, that slide switch 120 is in position "L1". Internal programming in the microprocessor U2 will cause a "wail" type square wave siren output to be generated and outputted via I/O port PA5. Further, the microprocessor U2 will bias the power amplifier into the Class AB mode of operation by sending an output signal from I/O port PD2 and will, further, set the values 3of the select lines 232 to the multiplexer U3. The resulting siren signal will be sent to the Y multiplexer output line. The Y output is connected via line 236 to the input of the power amplifier 250. Likewise, the information relating to the slide switch position will be sent via J1-10 at port PC7 of the microprocessor U2 to the input J108-10 of U101 on the relay board (FIG.9) and the L1 output relay will be energized.

The multiplexer U3 of the preferred embodiment can be a 4-channel/dual-output multiplexer such as the MC14052, made by MOTOROLA, which has a two-bit selection address responsible for connecting one input channel of channels Y0–Y3 to the output Y. In the present implementation, the X input/output of multiplexer U3 is not used. The multiplexer's inhibit terminal is connected to ground so as to keep the multiplexer continuously enabled. A logic table relating the select line addresses (most significant bit shown in the left hand column) to the signal outputs X and Y are shown in Table 3.

TABLE 3

| Select | Line | (MSB LSB) | OUTPUT Y |
|---|---|---|---|
| 0 | 0 | | SIREN SIGNAL |
| 0 | 1 | | SIREN SIGNAL |
| 1 | 0 | | MIC/P.A. |
| 1 | 1 | | RADIO REPEAT |

The select line information is sent from the microprocessor ports PD0 and PD1 directly to the A and B select lines (pins 10 and 9, respectively) of the multiplexer U3. Select line A is the select line which carries the least significant bit of the select line code.

The "bias-on" signal is sent via conductor 237 to bias switch circuitry 240 which operates to provide the bias for certain transistors located within the power amplifier 250. This "bias-on" signal serves to bias the amplifiers into a certain class of operation, or alternatively, into a low power mode.

Further, the microprocessor U2 is programmed to detect when the electronic dual siren apparatus 100 has been turned off at the microphone and control handle 110. If the microprocessor U2 determines that a predetermined period of time has passed without the receipt of binary control codes from the input circuit, the microprocessor U2 will alter the biasing of the power amplifier 250 to a low power consumption operating condition. Accordingly, the siren board circuit 200', while it remains operational at all times, will be in a condition so as to place a very small power load on the vehicle's electrical system when the control handle 110 is turned "off" thereby obviating the need for separate on/off switch on the power amplifier 250. When the control handle 110 is once again turned on and the transmission of control signals to the siren board circuit 200' is resumed, the microprocessor U2 will bias the power amplifiers to operate in the Class AB mode.

Biasing is accomplished at the amplifier as follows. The biasing signal is sent from port PD2 of the microprocessor U2 to the base of a transistor Q8, the collector of which is connected to the base of an NPN transistors Q5. Resistor R23 is provided to limit excessive current to the base of the transistor Q8, the emitters of which are connected to the +5 V regulated power supply 212. Resistor R24 limits the current to the base of transistor Q5. The transistors Q8 and Q5, provide a bias to the amplifier circuitry in a manner substantially similar to that explained in detail in U.S. Pat. Nos. 4,646,063 and 4,189,718, those patents previously incorporated herein by reference. Further, the power amplifier is substantially the same as shown in FIG. 4*c* of U.S. Pat. No. 4,646,063 and as disclosed in U.S. Pat. No. 4,189,718, that patent incorporated herein by reference, and produces a high power signal to the speaker 265 (FIG. 6) as disclosed in those references.

The siren board circuit 200' of the electronic siren apparatus includes a radio input circuit 225 that controls the application of a vehicle's two way radio receiver output to the siren power amplifier 250. The radio input circuit includes a volume control potentiometer R1 and an isolation transformer T2. Additionally, biasing and filter capacitors C6 and C16 and resistors R2 and R3 are provided. The output of the radio input circuit is sent to inputs Y3 of the multiplexer U1 to be applied to the power amplifier 250 when the radio repeat mode is selected at the control handle 110.

Figure 8D:
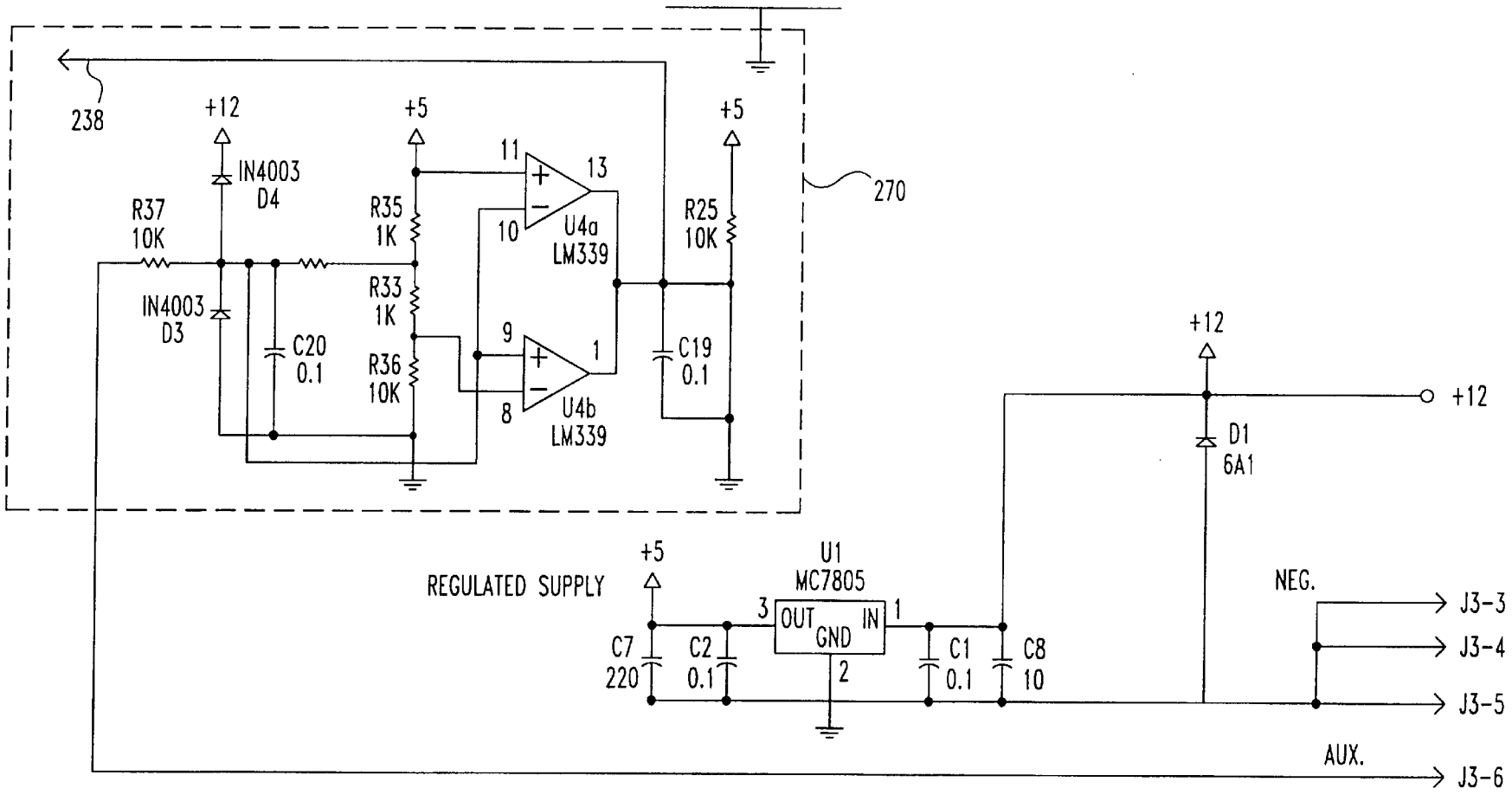

In FIG. 8D, there is shown the isolated, regulated +5 V power supply 212. The regulated power supply 212 receives a +12 V input from the relay board circuit, described herebelow, through the fuse F108 (FIG. 9), so as to isolate the circuitry from the vehicle's power supply in the case of excessive current flow therefrom. Connection to the +12 V terminal of power supply 212 will provide +12 V to the amplifier 250 and to various portions of the circuitry, as well as to the voltage regulator IC U1.

Power supply 212 includes a conventional voltage regulator U1, such as the MC7805 made by MOTOROLA, and a plurality of parallel connected capacitors C1, C2, C7 and C8 to filter out noise and to smooth the output voltages therefrom and a reverse biased blocking diode D1. The input terminal of the voltage regulator U1 is connected to the +12 V source terminal from the relay board circuit 300'. Power supply 212 produces a regulated +5 V D.C. power source at its output terminal which is used throughout the receiver circuit whenever a +5 V source is required. Terminals J3-3–J3-5 provide a ground connection for various external devices.

Additionally included in the siren board circuitry is an auxiliary input circuit 270. Auxiliary input circuit 270 receives an auxiliary input, via conductor J3-6, typically from the horn ring circuit 275 of the vehicle. The signal on line J3-6 is applied to a voltage divider and then to a window comparator made up of two comparators, U4*a* and U4*b*, contained on a single IC, such as the LM339 Quad single supply comparator device made by MOTOROLA. The noninverting input of the comparator U4*a* is connected to the +5 V source, whereas the inverting input of the comparator U4*b* is connected to a reference voltage through a voltage divider. The input to the inverting input of comparator U4*a* and the noninverting input of comparator U4*b* comes through a voltage divider. When a voltage is applied across the auxiliary input line J3-6 that is within the range between the reference voltages applied to the comparators U4*a* and U4*b*, a signal will be sent to the input PD7 of the microprocessor U2 so as to cause the microprocessor U2 to generate a siren tone based on the auxiliary input from the horn ring circuit over line J3-6. Thus various manual functions can be controlled by depression of the vehicle horn button. Alternatively, the same can be accomplished using the siren or override button 135 on the microphone and control handle 110.

RELAY BOARD

Referring now to FIG. 9 there is shown a circuit diagram for the relay board 300' of one preferred embodiment of the present invention. The relay board 300 includes an octal peripheral driver array U101, such as the ULN2803 made by MOTOROLA, which is useful for interfacing between the low logic level output from the microprocessor U2 of the siren board 200' (FIGS. 8A–8D) and a set of relays. The outputs 01–03 and 05–08 are connected to the relays K101–K107. Optionally, an additional relay may be connected to output 04, so as to provide for control of an additional auxiliary function device. Additionally, pin 10 of the driver array U101 is connected to the +12 V vehicle supply, whereas pin 9 is connected to ground.

In the preferred embodiment inputs J108-1 and J108-2 are connected to ground, whereas J108-3 through J108-10 are connected to J1-3 through J1-10, respectively, of I/O ports PC0–PC7 of the microprocessor U2 of FIG. 8A. As such, outputs from the microprocessor corresponding to certain auxiliary function controls selected at the handle 110 are provided to the driver array U101. A high input from the microprocessor U2 will produce a low output from the driver array U101 capable of energizing a corresponding relay K101–K107. Once energized, the normally open relay will close, thus connecting the auxiliary function device to a +12 V supply, through a 20 A fuse. Note that when using the microprocessor and driver array U101 multiple relays may be energized simultaneously. A given relay will remain closed so long as the corresponding output from the driver array U101 is low.

For example, output 01 (pin 18) of the driver array is connected to the relay K101. When relay K101 is energized, the connector J101 is connected to the +12 V supply through the 20 A fuse F101. Thus, overcurrent protection is provided to the auxiliary function device connected to connector J101 when the relay K101 is selectively energized. When optical switch of the handle 110 is in position L1, as explained above, a control signal is sent from the handle 110 to the siren board, and thus to the microprocessor. An output from the microprocessor indicating the selection of the switch position L1 at the control head will cause the driver array U101 to close the relay K101, thus turning one warning light circuit on. If the optical switch 120 is in the L2 position, the microprocessor U2 provides an output to the driver array U101 which energizes relays K101 and K102, thus activating both the first warning light circuit and a second warning light circuit. Likewise, when the optical switch is in the L3 "L3 Default mode" active position the microprocessor provides an output to the driver array U101 which energizes relays K101, K102 and K103, thus activating first, second and third warning light circuits, as well as causing the siren to emit a yelp siren or allowing the horn ring to blow the siren.

Similarly, the depression of any of the auxiliary function control switches at the control head can cause the microprocessor to output a signal to the driver array U101 which will energize any or all of the relays K104–K107, thus selectively powering auxiliary devices, such as gun locks, alley lights or spot lights. As shown in FIG. 3, the fuses F101–108 are externally accessible at the relay section of the receiver box, so as to permit easy access when necessary.

As is further shown in FIG. 9, connectors J109 and J110 are tied to the +12 V vehicle supply. Additionally, the +5 V regulated power supply on the siren board is additionally connected to the +12 V vehicle supply through fuse F108.

Figure 11A:
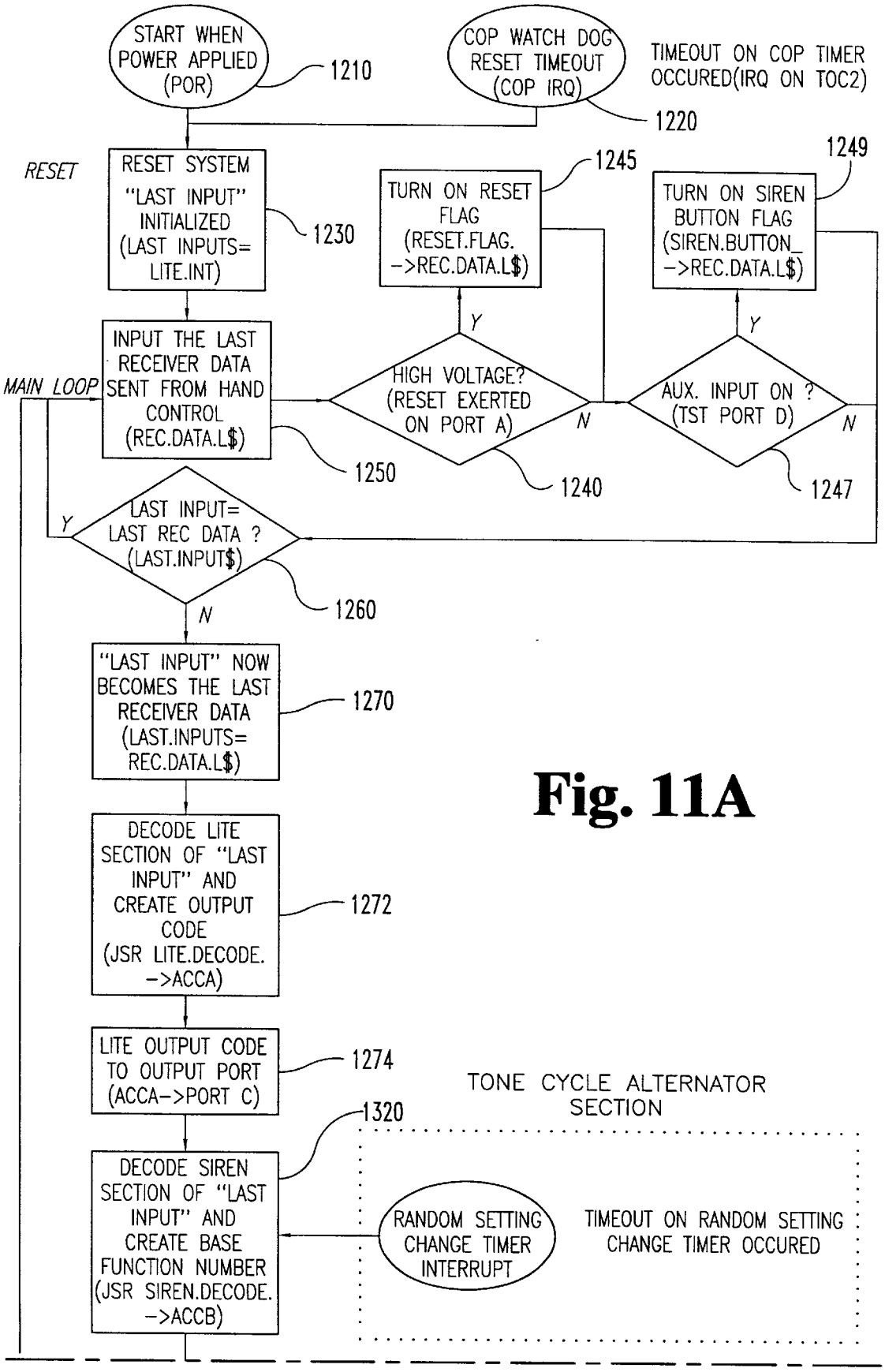
FIGS. 11A–11B are a flow diagram of the methodology of one embodiment of the present invention which may be implemented using the microprocessor of FIG. 8A.
Figure 11B:
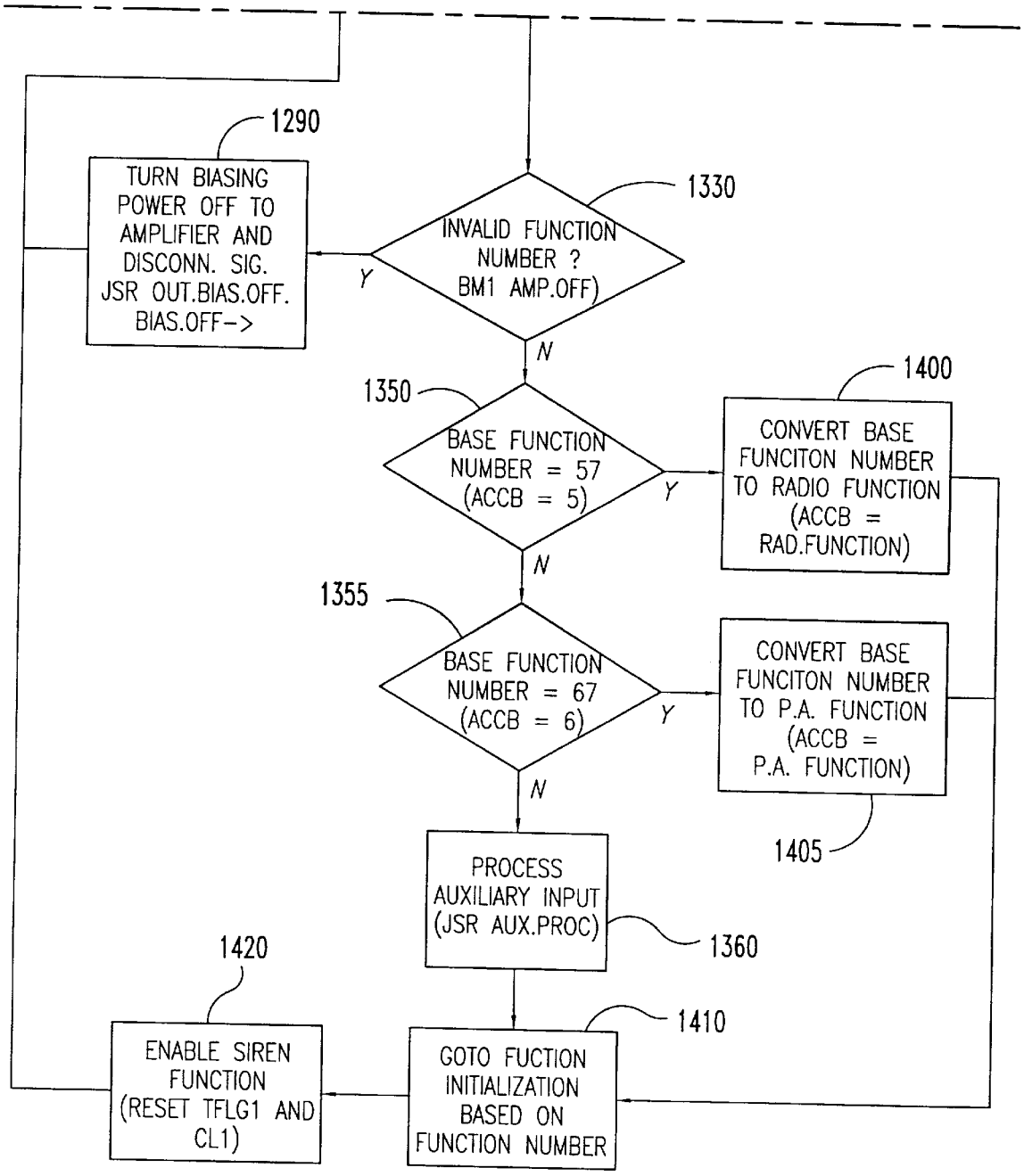

FIGS. 11–13 are flow diagrams of the methodology of one embodiment of the present invention which may be implemented using the electronic siren apparatus of FIGS. 6–9. FIGS. 11A–B describe the steps in the main operating loop followed by the control program resident in the microprocessor 215 of FIG. 6. The present flow diagrams describe programming that enables the creation and/or production of signal waveforms. The main loop of the control program is entered either when power is first applied to the receiver circuit, step 1210, or after a reset timeout protection algorithm resident in the microprocessor resets all ports in response to a detected interrupt condition, step 1220. Once the main loop has been initialized, the system is reset and the "last input" value is set to the value of LITE.INIT, step 1230. The "last input" value corresponds to the binary signal representation of the position of the function switches at the microphone and control handle 110.

Next, the control program inputs the last binary value (REC.DATA.L$) received from the microphone and control handle 110, step 1250. Initially, the control program causes the microprocessor to analyze the signal received from the high voltage protection circuit over input line PA0 of FIG. 6*b*. If the input is "low", or a logic "0", step 1240, a reset flag is turned on, step 1245.

If the voltage is determined to be at a normal level, the control program checks to see if an auxiliary input signal is present at port PD7 of the microprocessor U2 (FIGS. 8A–8D), step 1247. If an auxiliary input signal is present, a siren button flag is turned on, step 1249.

The control program then checks to see if the "last input" value is equal to the last value received from the control handle 110, REC.DATA.L$, step 1260. If so, then the control program returns to step 1250. If the "last input" value and the last value received from the control handle are different, indicating that a new selection has been made at the microphone and control handle 110, then the new "last input" value is set to the most recent value received from the microphone and control handle, step 1270.

Figure 12A:
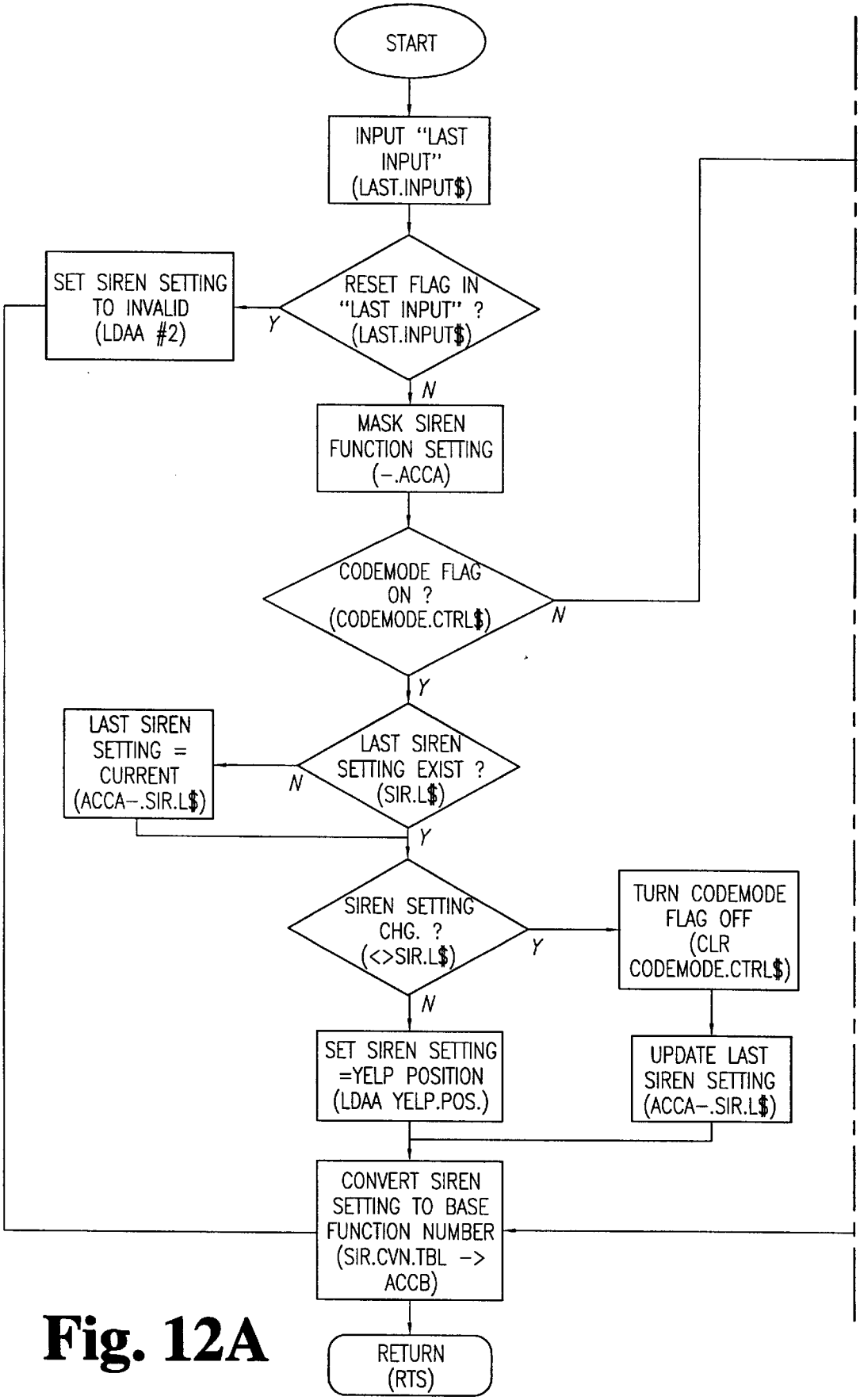
FIGS. 12A–12E are flow diagrams of the methodology of certain subroutines called upon in the flow diagram of FIG. 11.
Figure 12B:
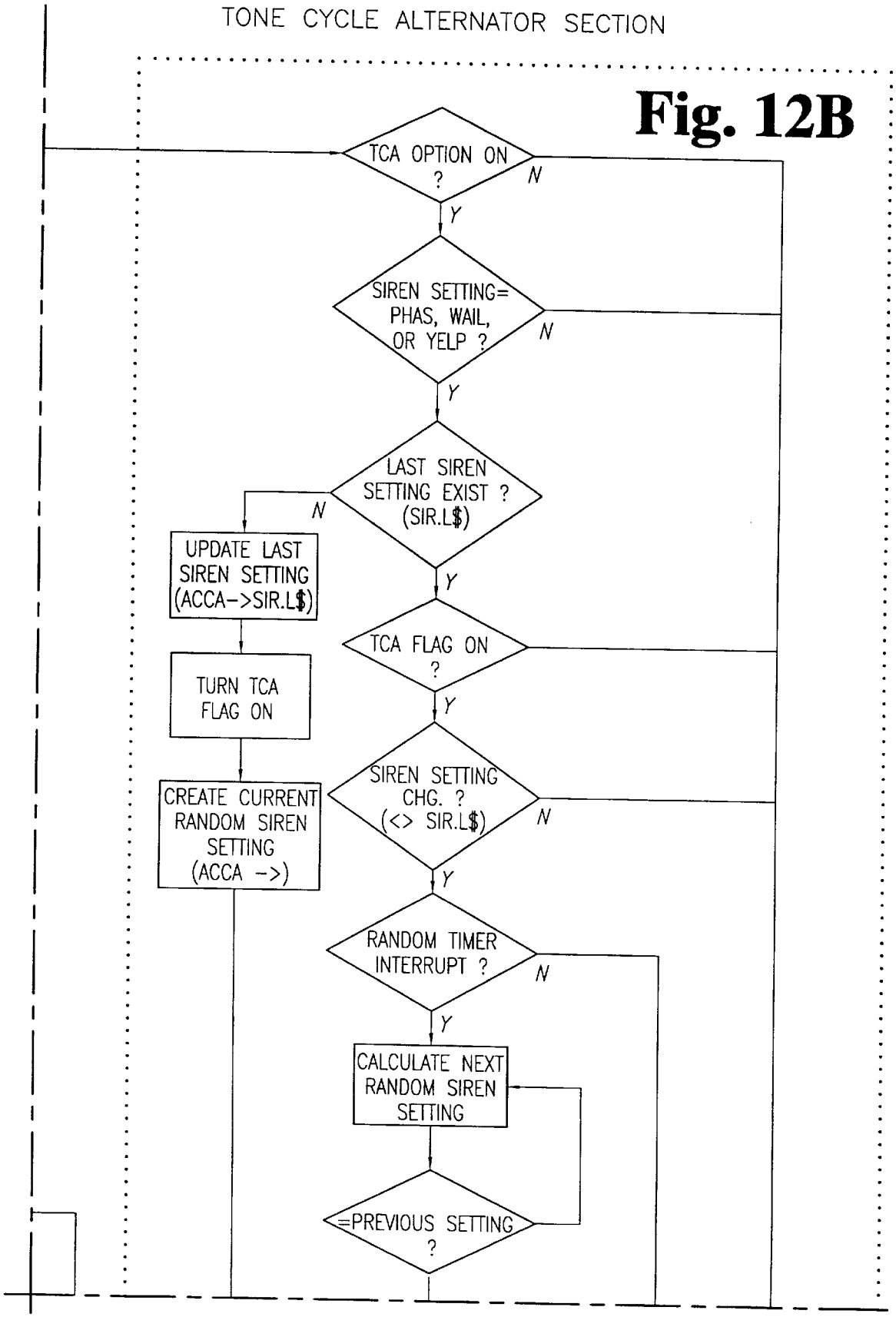
Figure 12C:
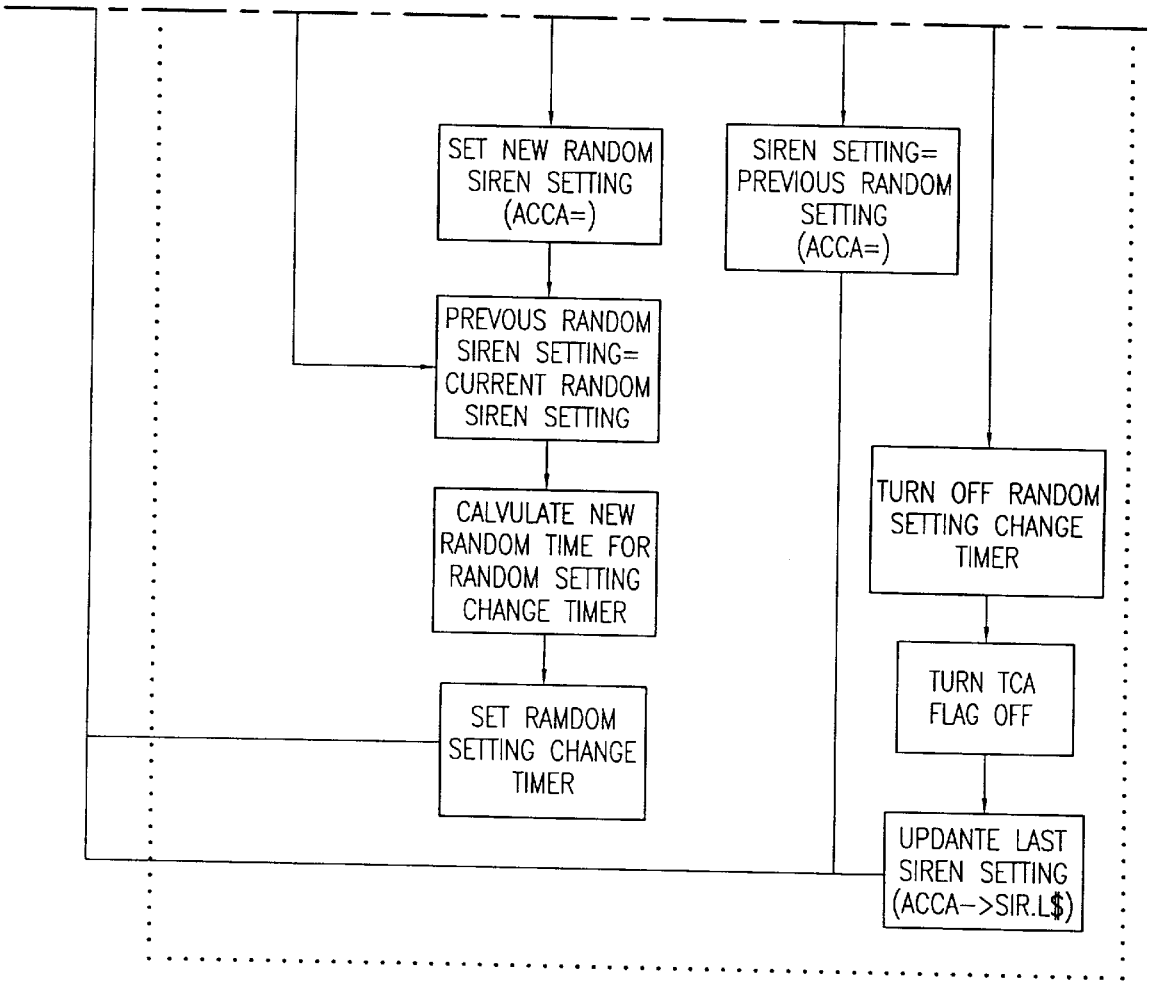
Figure 12D:
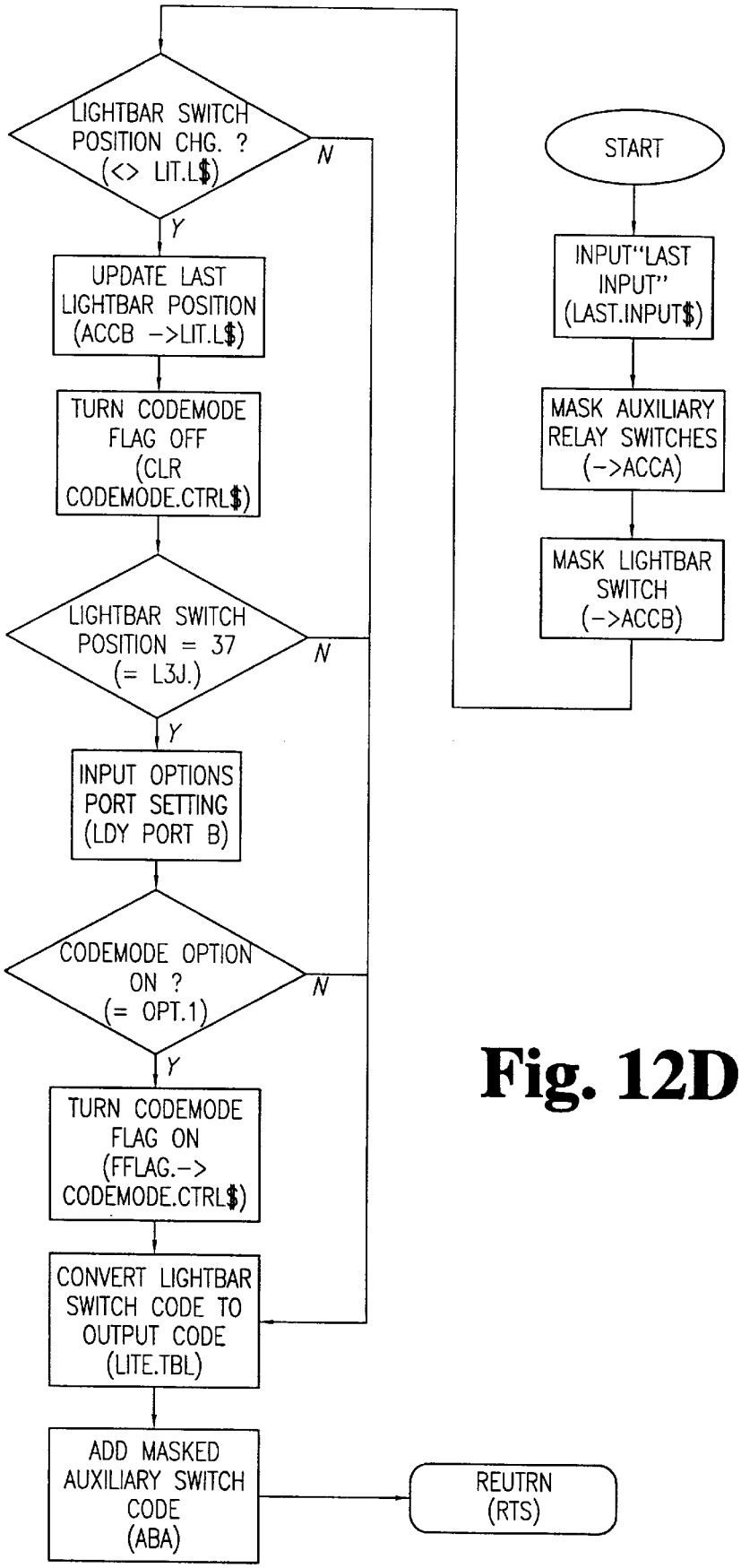
Figure 12E:
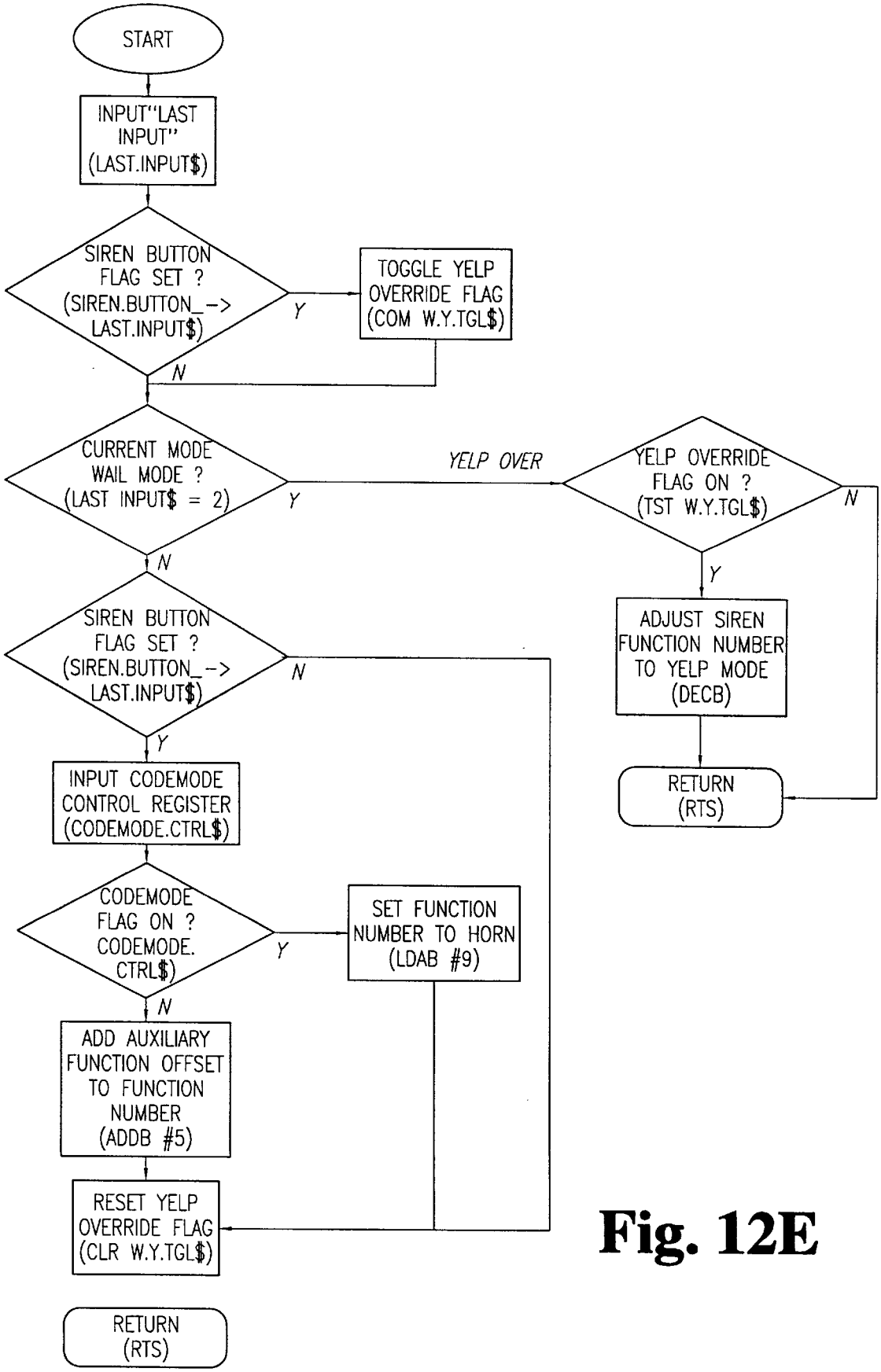

The control program then decodes the light or LITE section of the "last input" by jumping to the LITE.DECODE subroutine of FIG. 12A, step 1272. After returning from the LITE.DECODE subroutine, the light output codes processed and corresponding outputs are sent to the appropriate output ports C of the microprocessor U2. From there, the output signals are sent to the appropriate drivers on the relay board, step 1274, so as to activate any light circuits requested at the control head 110.

Next, the control program decodes the siren portion of the data signal using the SIREN.DECODE subroutine. A base function number corresponding to the siren commands requested at the control handle is set, step 1320. Note that the siren section and base function number may be affected by the "Tone Cycle Alternator" section of code located in the SIREN.DECODE subroutine, step 1276.

The tone cycle alternator mode of operation is one wherein random or multiple sequential sequences of more than two siren tones are allowed without operator intervention. The tone cycle alternator section of code in the FIG. 12D, instructs the microprocessor to handle any number of tones (including ones not predefined on the function control label) and is capable of doing this in a changing or random sequence. Like the "L3" default mode described above, the microprocessor is used to permit the user to rapidly deactivate the TCA mode without interruption or complete shutdown of the siren and light controls. Note that the term "code mode" appearing in the flow diagrams of FIGS. 11–14 refers to the "L3" default mode. If the siren board is programmed to enable the TCA mode, the TCA mode is initiated as a default setting when the power switch is set to the on position and the rotary function switch (145 of FIGS. 2, 3 and 6) is set in one of the Phaser (two-tone), Yelp or Wail positions. The siren system will not automatically default to TCA mode if the rotary function switch is in the Manual, Horn or Radio positions.

Deactivation of the TCA mode is achieved by changing the function selector switch or by pressing the PTT button. If the slide switch 120 is set in the "L3" position when the power is turned on to the control handle 110, the "L3" default mode operation will override the TCA mode as long as the "L3" default mode is active. The siren/override function is available while in the TCA mode and the override function is determined by the current tone being emitted by the siren. The TCA mode may be programmed by removing the cover on the receiver/amplifier box and soldering a jumper to the PC board at the microprocessor U2, as described above in connection with FIG. 8A. Alternatively, the TCA mode may be externally programmable using an option program or DIP switches.

Returning now to FIG. 11, after the siren section of the data is decoded and a base function number is created, step 1320, the base function number is checked to see if it is a valid function number, step 1330. If the base function number is invalid then the biasing signal to the power amplifiers is turned off, step 1290. Additionally, any amplifier output signals are discontinued, step 1290, and the control program is returned to step 1250.

If the base function number is a valid function number, it is then checked to see if it corresponds to the base function number designating the Radio function, step 1350. If so, the microprocessor would convert the base function number to the radio function number, step 1400. If it is determined from the base function number that the public address system (P.A.) is active, the base function number would be converted to a value indicative of the use of the P.A. system, step 1310. If the base number does not indicate that either the Radio or P.A. functions have been requested at the control handle 110, then any auxiliary inputs present are processed by the AUX.PROC subroutine of FIG. 12C, step 1360.

Figure 13A:
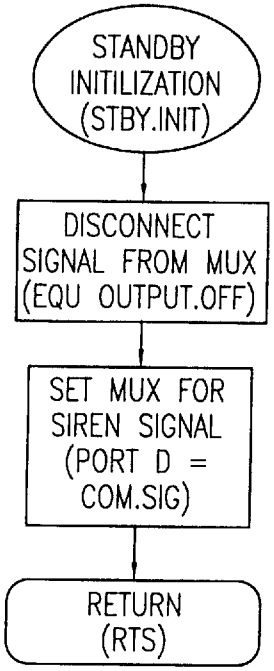
FIGS. 13A–13J are flow diagrams showing the methodology of the subroutines which are called by the control program illustrated in connection with FIG. 11 for initializing certain siren, P.A. and radio repeat functions.
Figure 13B:
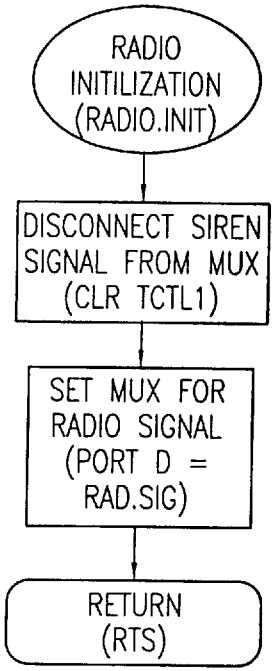
Figure 13C:
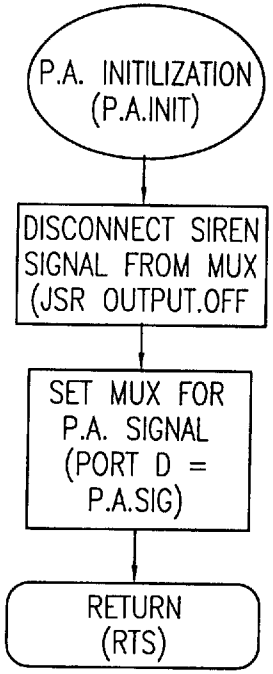
Figure 13D:
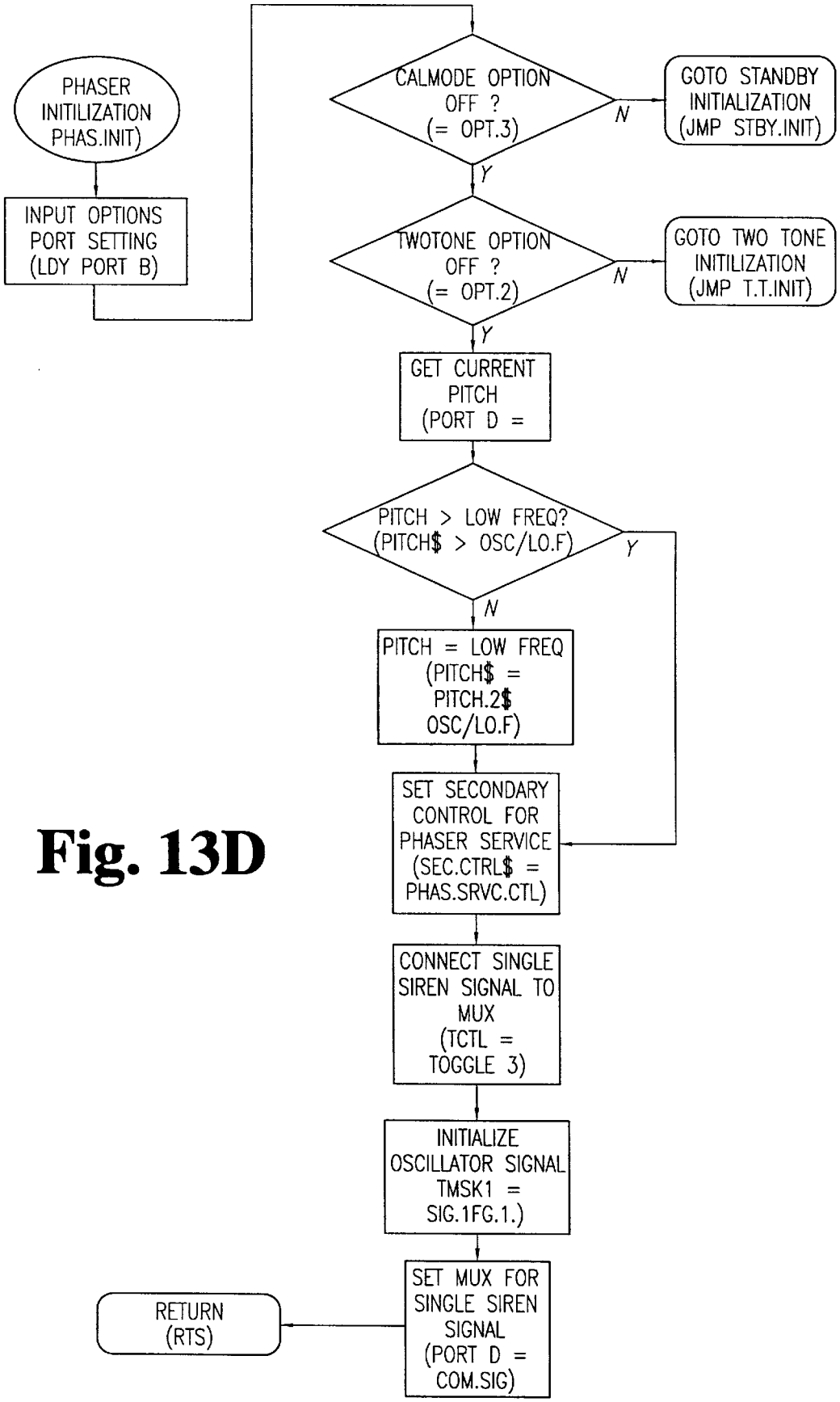
Figure 13E:
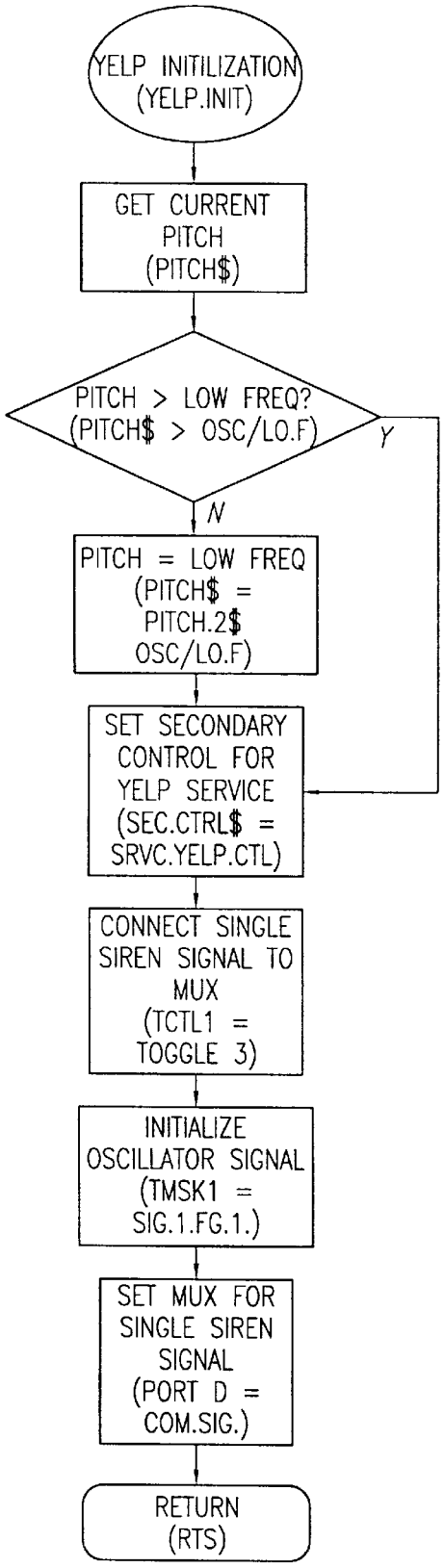
Figure 13F:
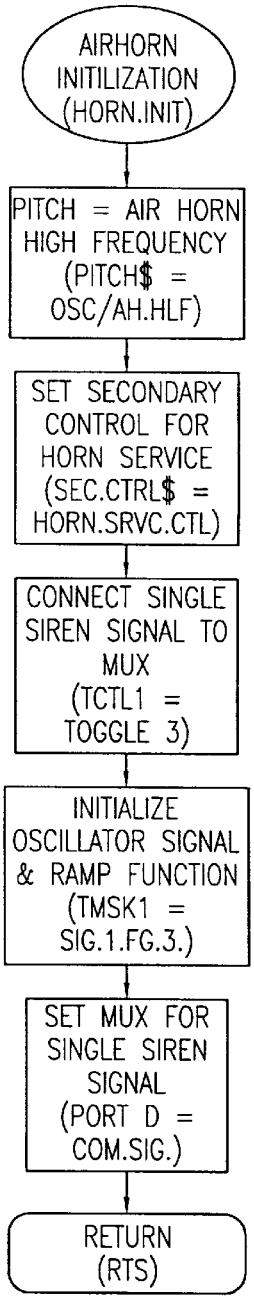
Figure 13G:
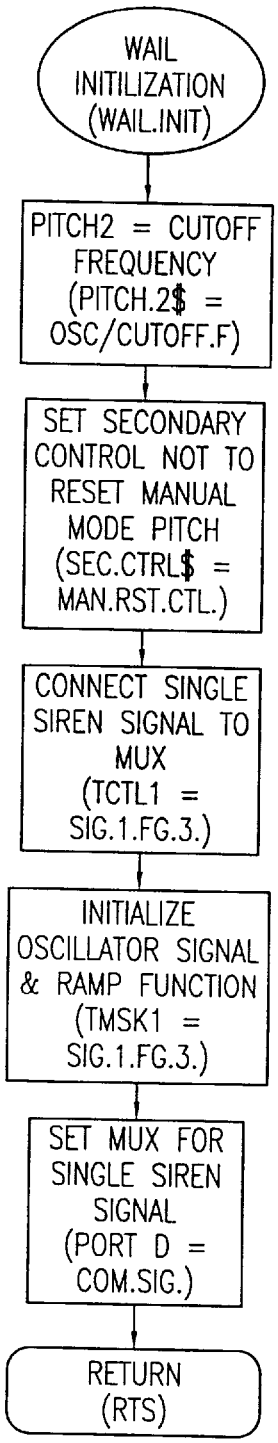
Figure 13H:
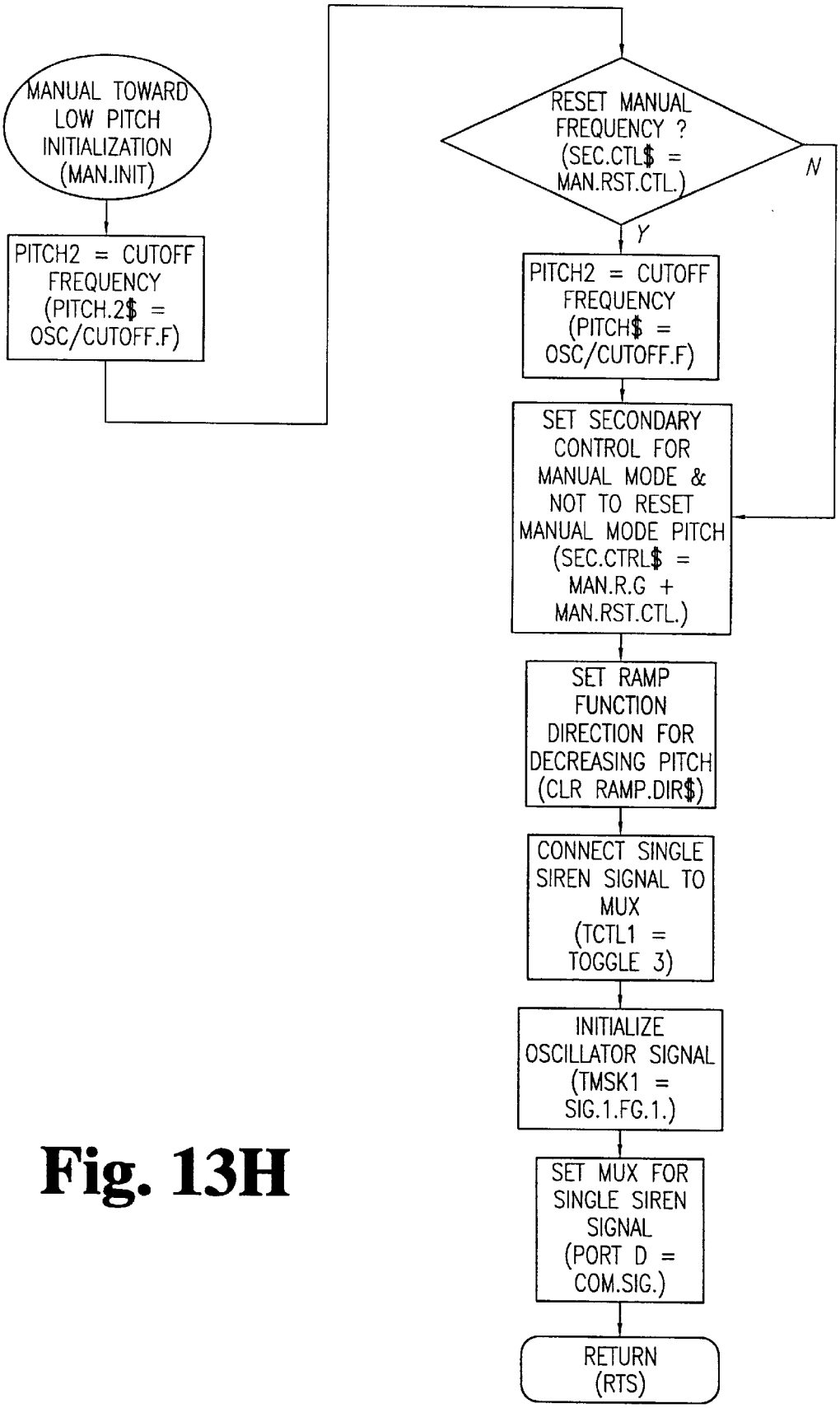
Figure 13I:
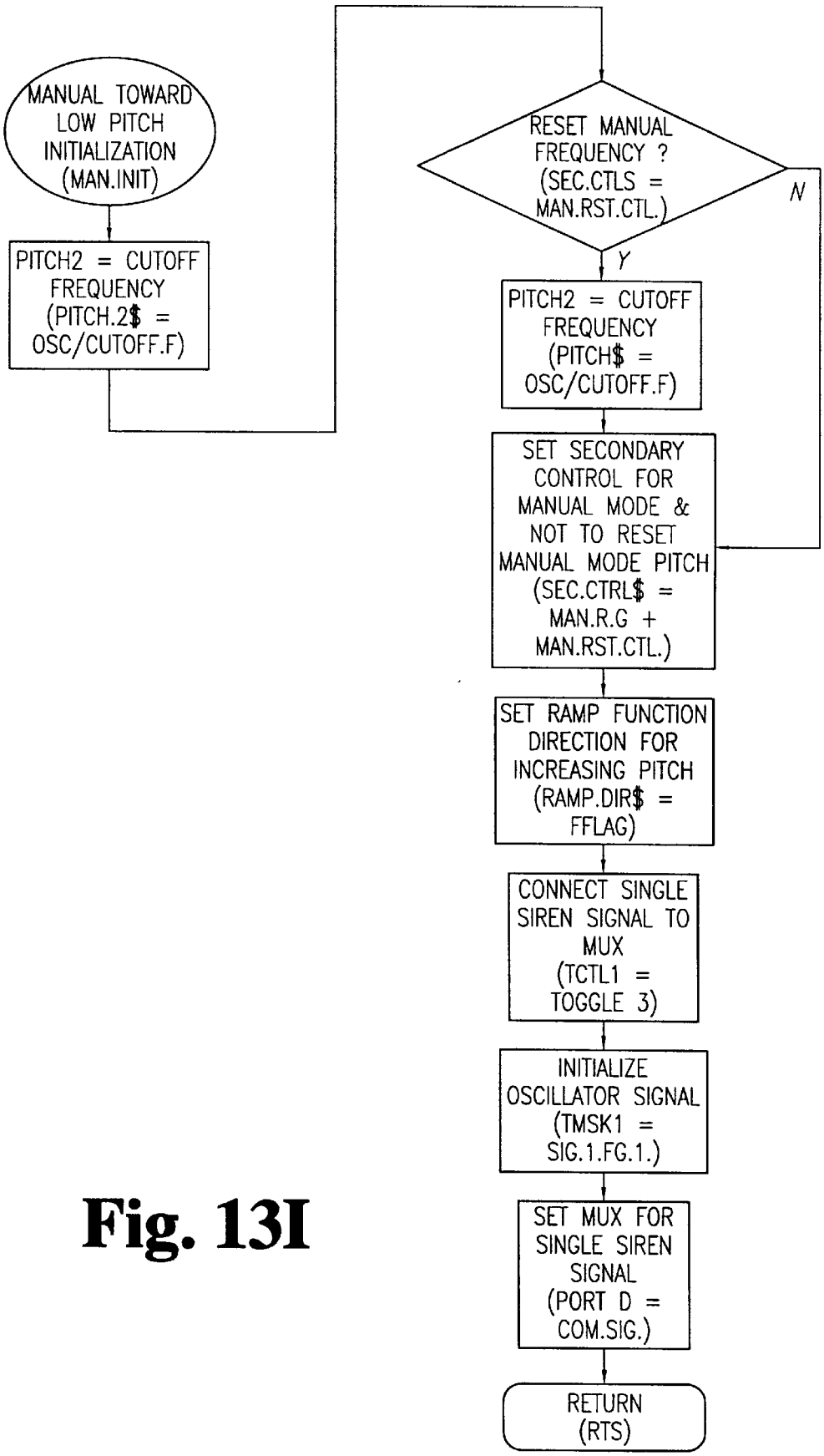
Figure 13J:
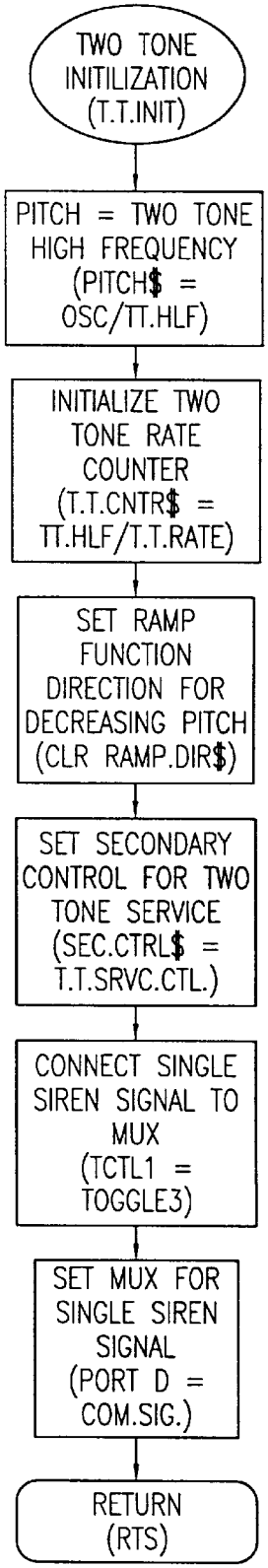
Figure 14A:
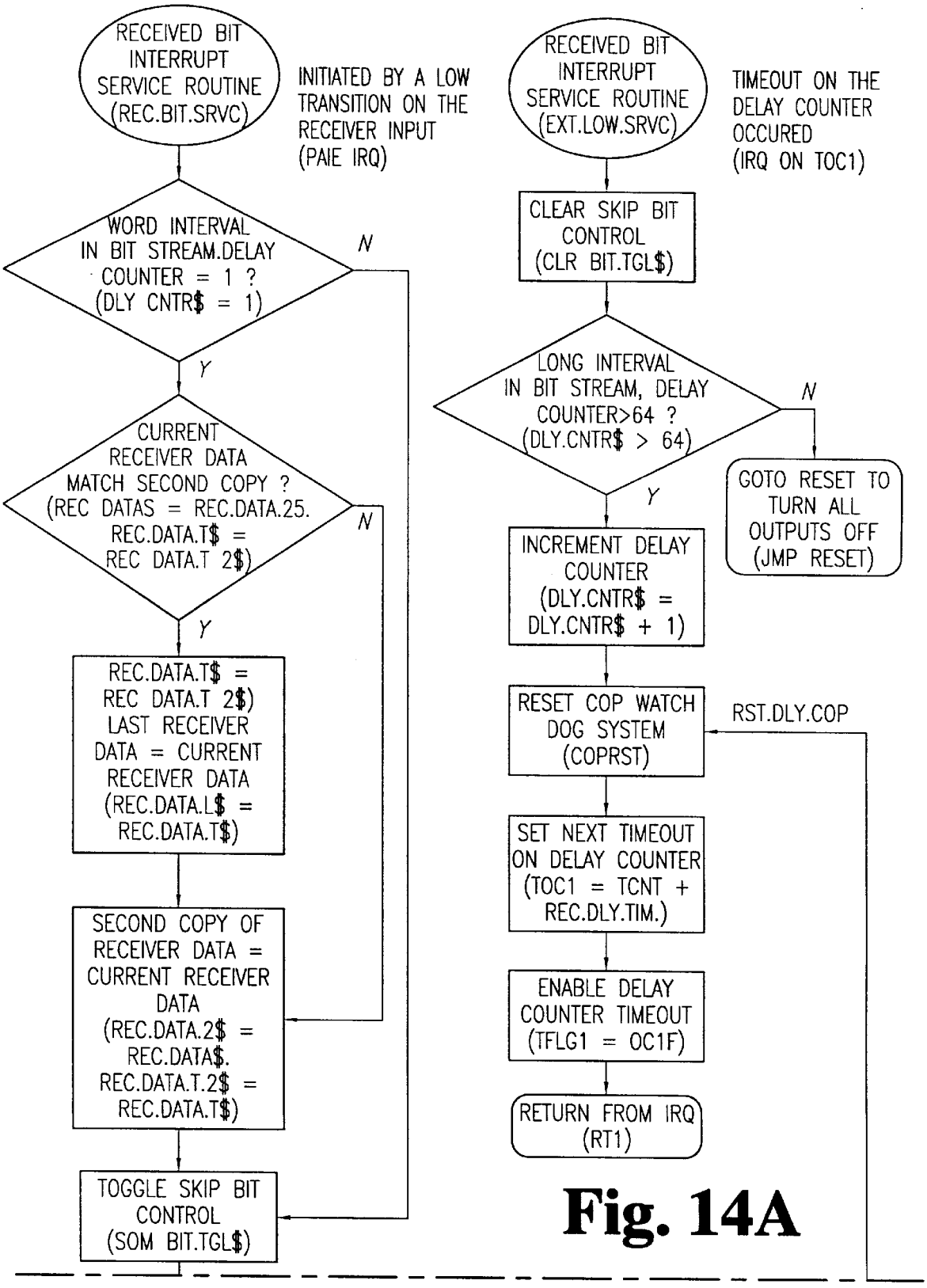
FIGS. 14A–14I are flow diagrams showing the methodology of the service routines called by the subroutines illustrated in connection with FIGS. 13A–13J.
Figure 14B:
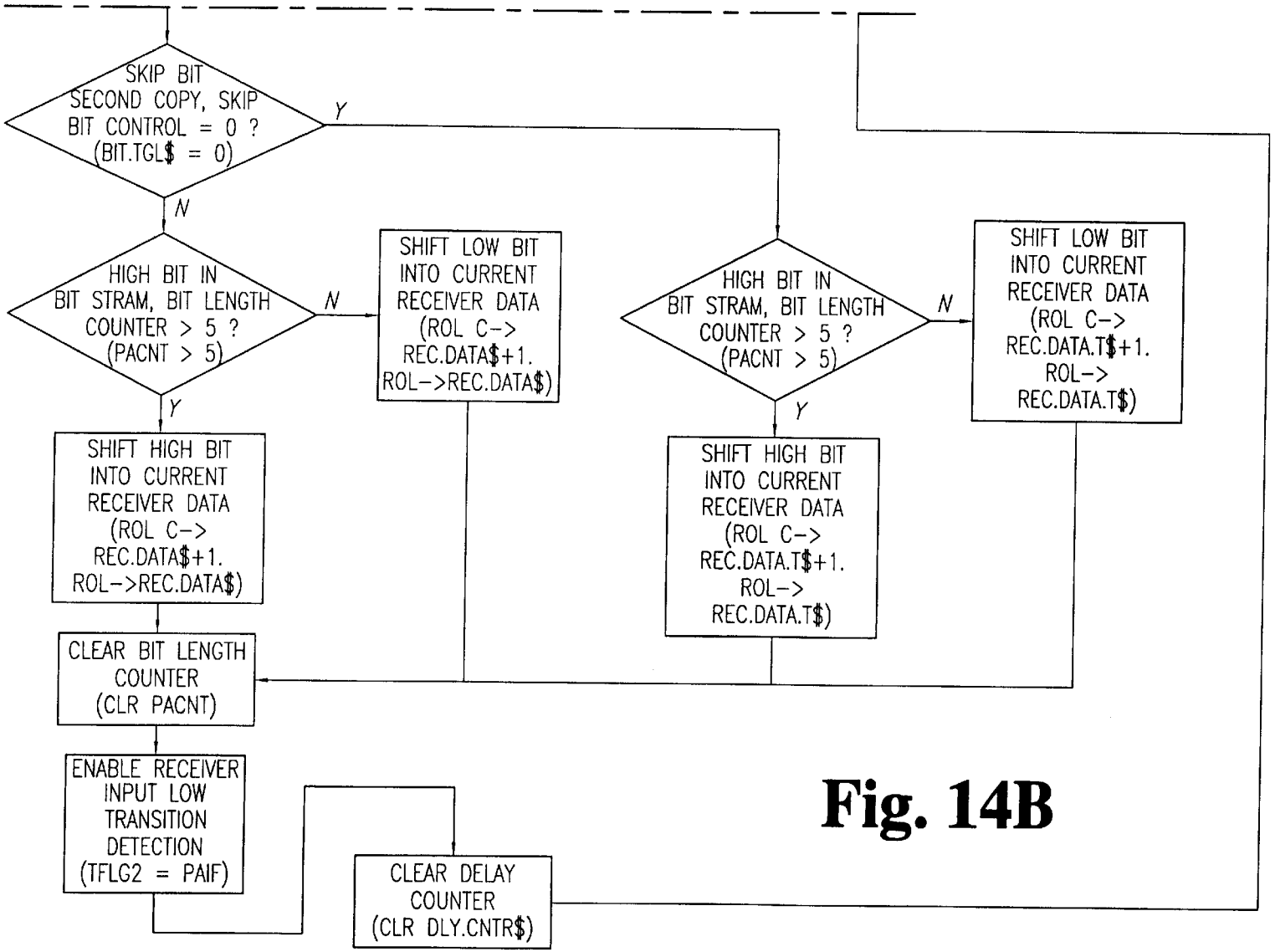
Figure 14C:
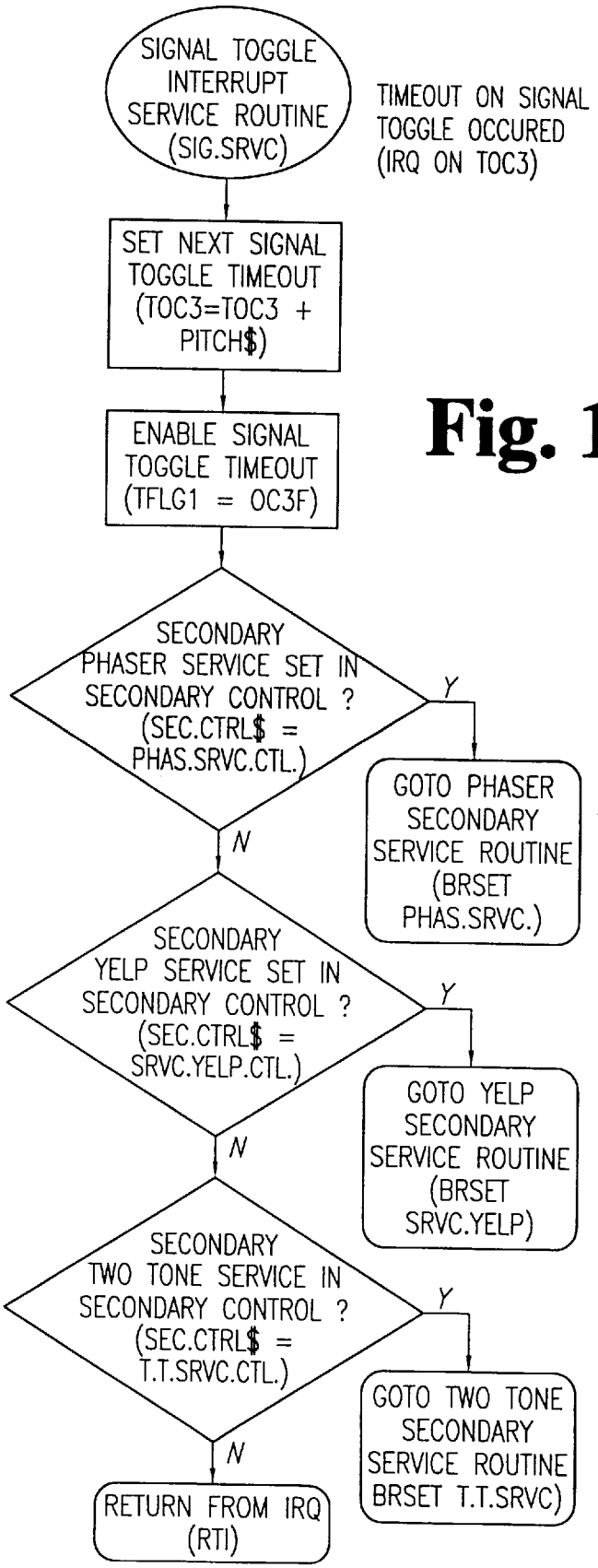
Figure 14D:
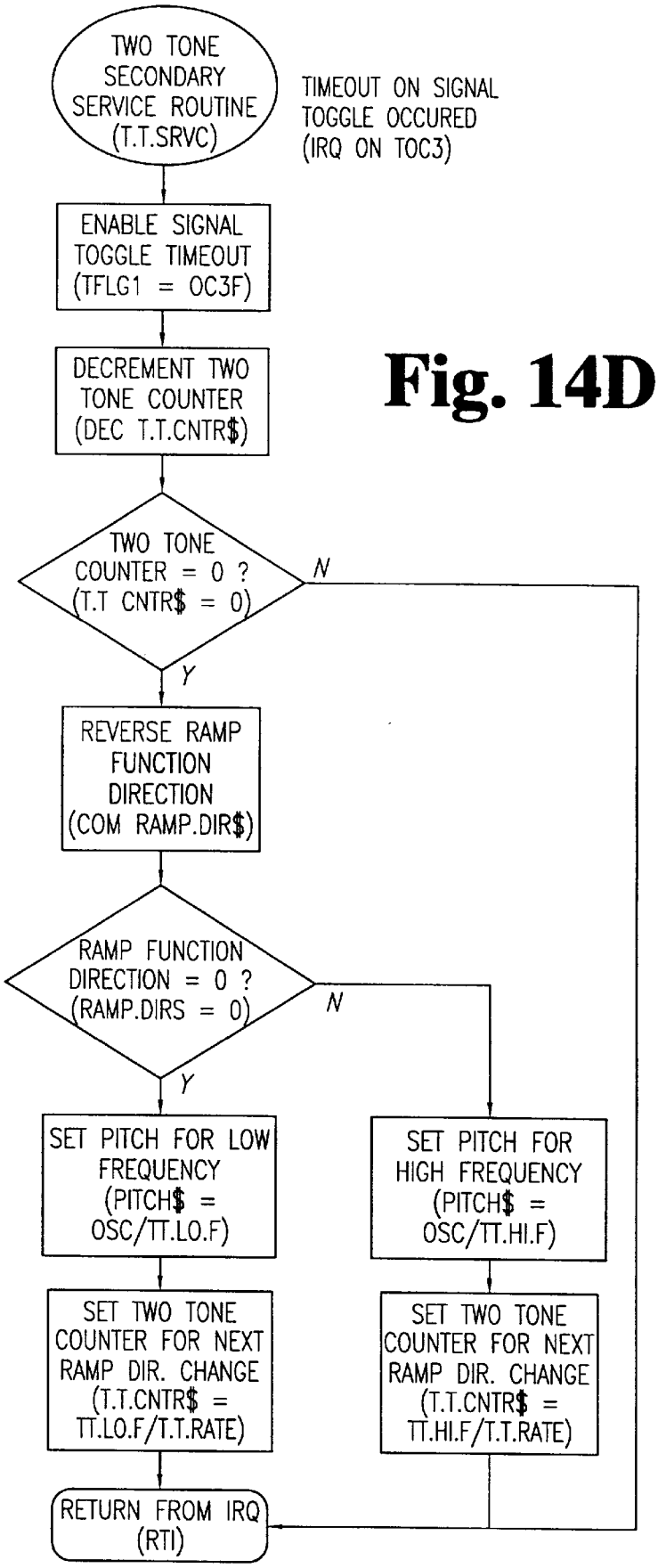
Figure 14E:
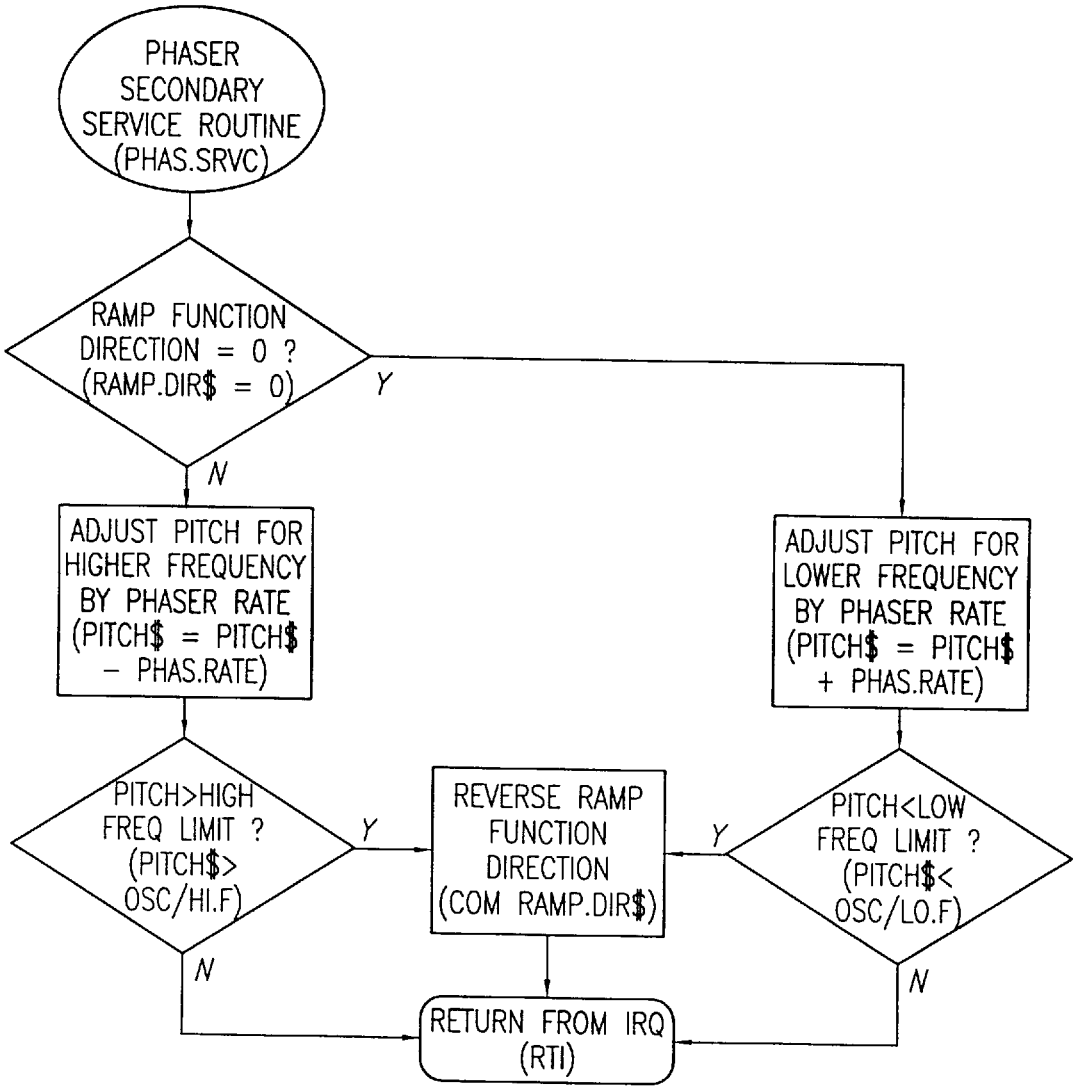
Figure 14F:
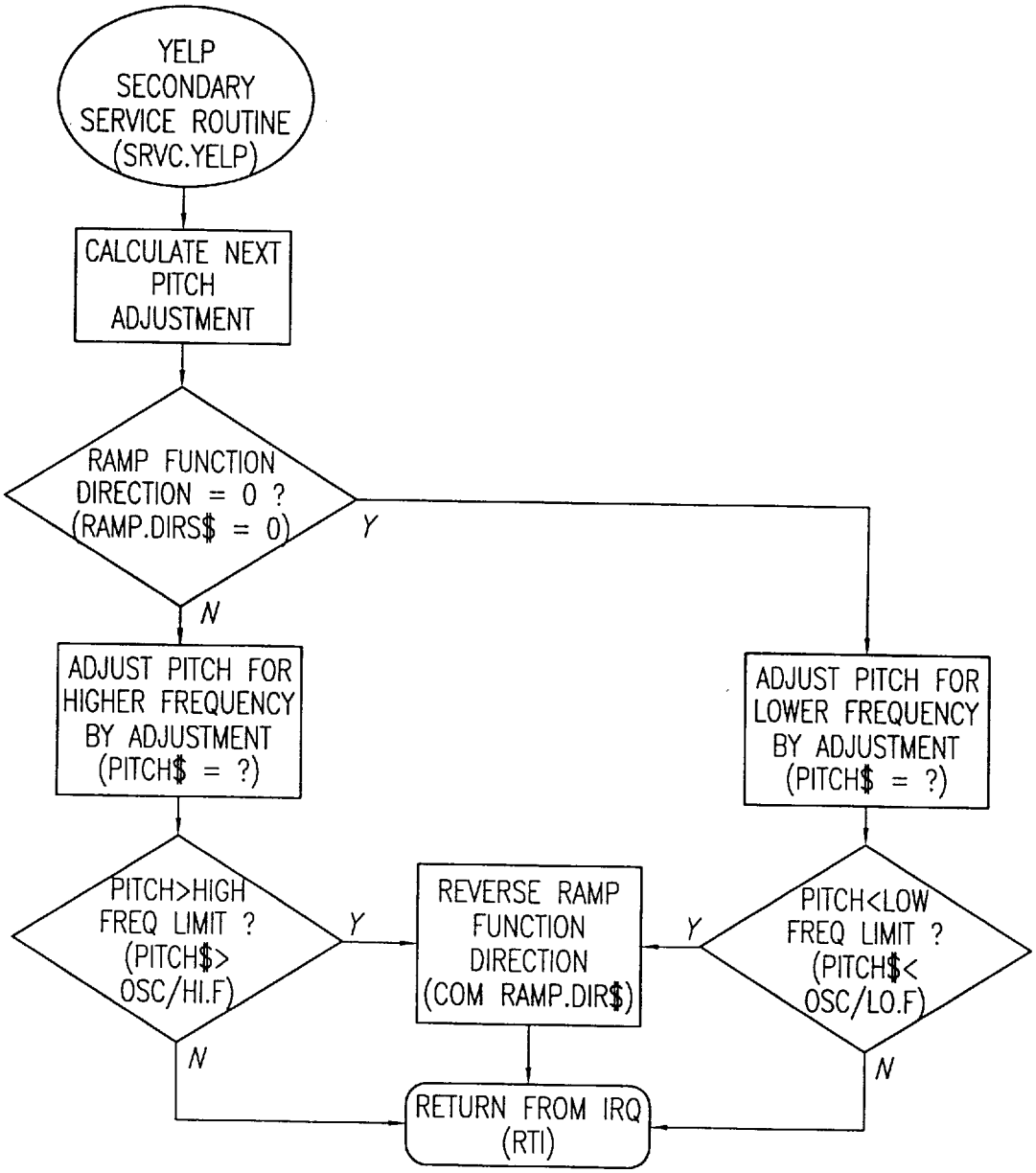
Figure 14G:
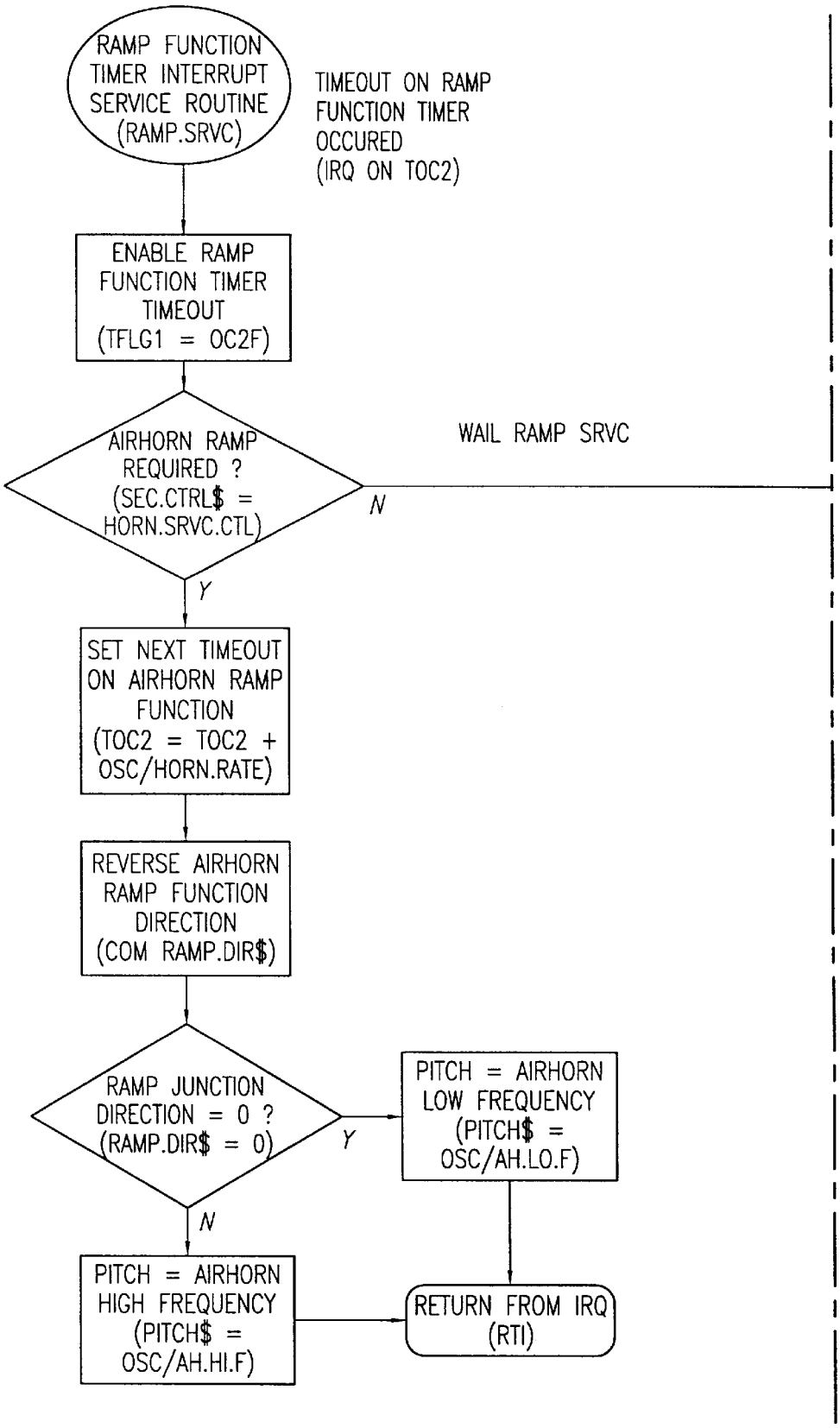
Figure 14H:
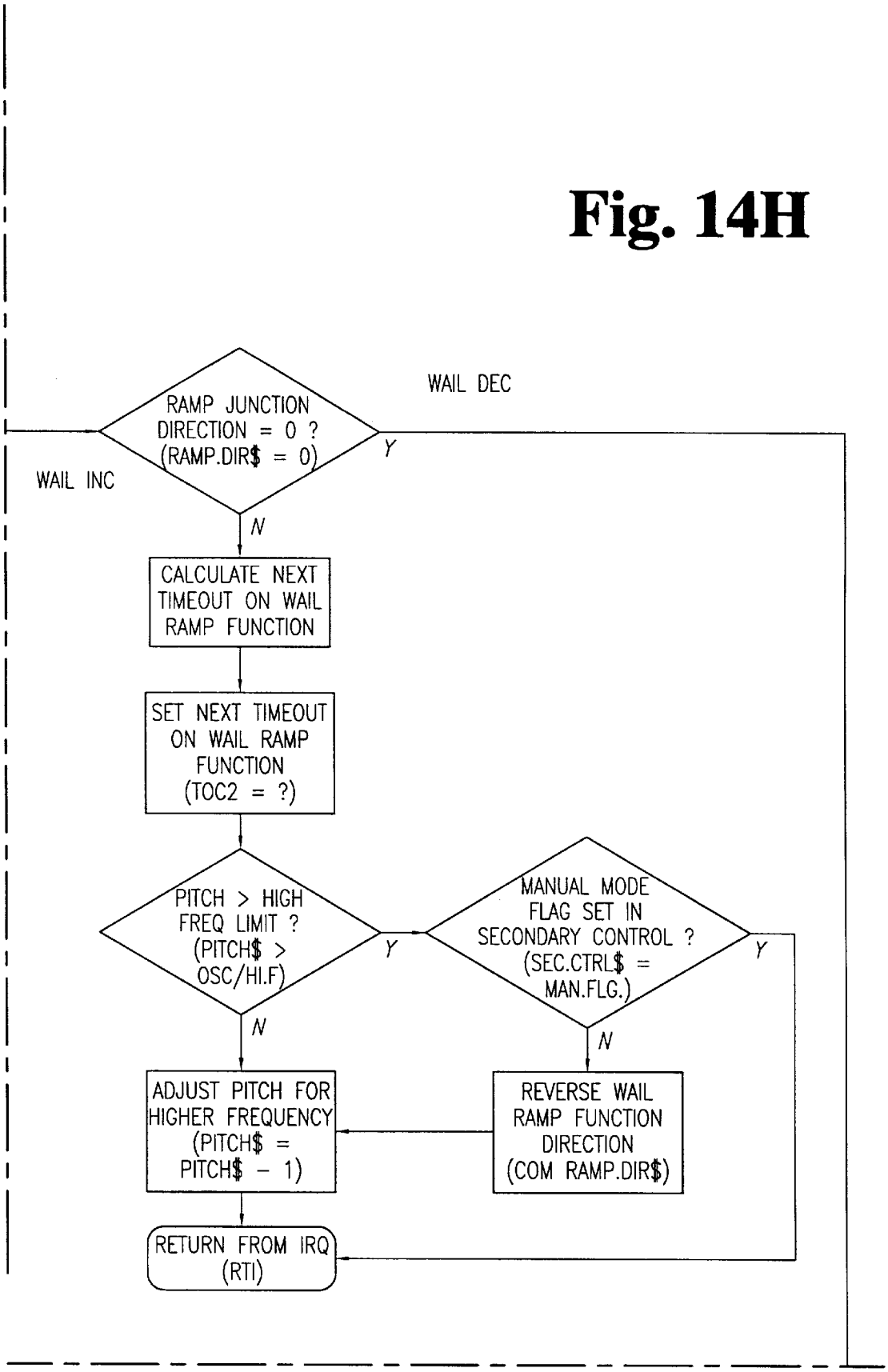
Figure 14I:
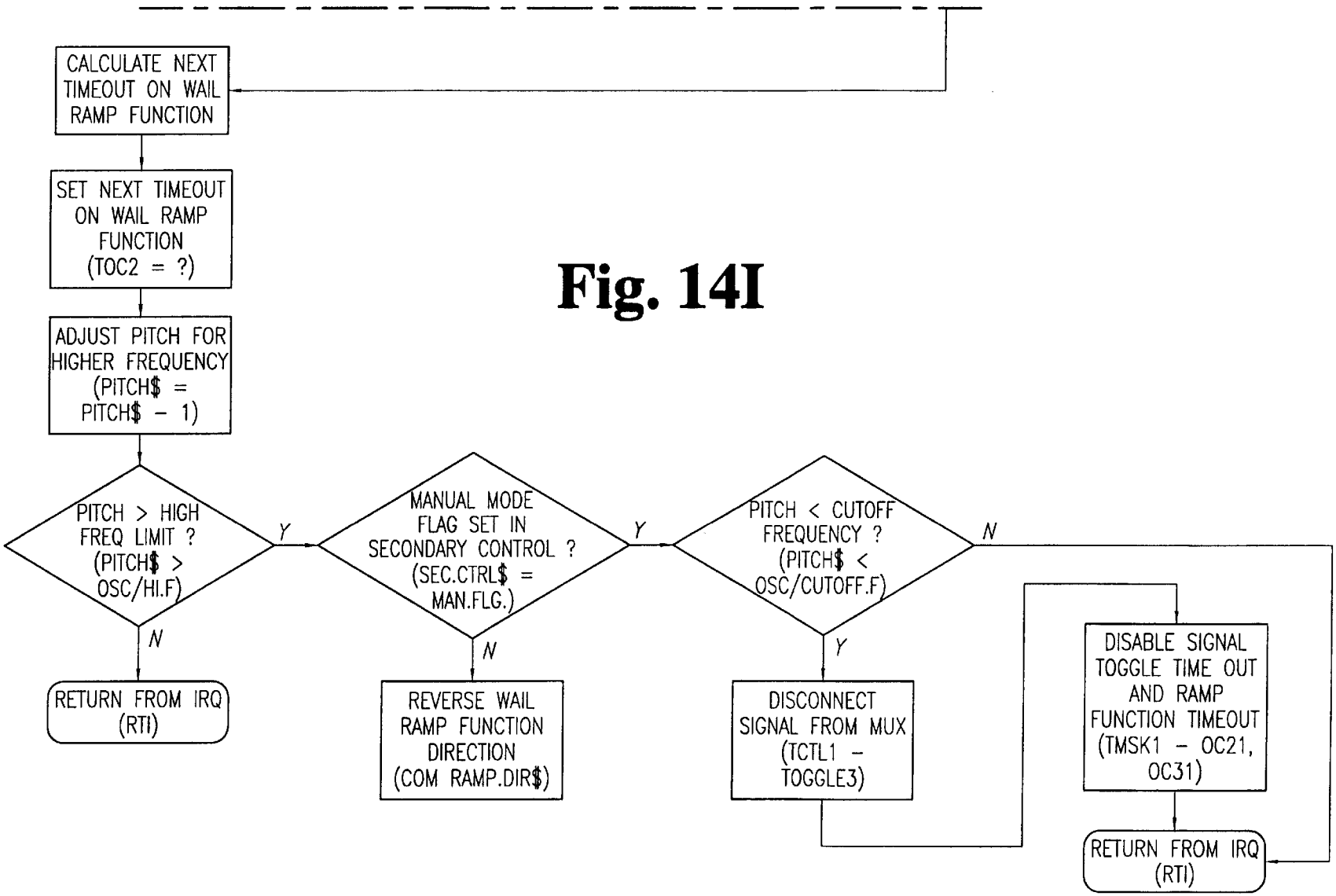

After checking the base function number and/or processing any auxiliary inputs, the control program would then proceed to step 1410, wherein the program would go to the appropriate initialization subroutine of FIGS. 13A–13J, according to the assigned base function number, step 1410. For example, if the base function number has been determined to indicate that the P.A. initialization subroutine shown in FIG. 13*c* is desired, that subroutine would be run. The amplifier would be enabled and the output generated by the microprocessor U2 according to the desired siren function would be output from the speaker, step 1420. The control program will then return to step 1250. The signals initialized by the subroutines accessed in step 1410 will continue to be enabled by the microprocessor U2 until either a high voltage is detected, or a new rotary function switch position, auxiliary function or power off condition is detected at the microphone and control handle 110.

As noted above FIGS. 13A–J show the flow diagrams for the initialization subroutines that are called up in step 410 of FIG. 11. FIG. 13A shows the flow diagram for a standby routine used to disconnect the signals from the multiplexer to prevent a signal from being sent to the power amplifier 250.

FIGS. 13B, 13C, 13D, 13E and 13F show the flow diagrams of the subroutines used for initializing the radio, the P.A. system, the phaser siren routine, the yelp siren routine and the airhorn routine, respectively. FIGS. 13G, 13H, 13I and 13J show the flow diagrams for initializing the wail siren routine, the low or decreasing pitch manual siren routine, the high or increasing pitch manual siren routine, and the high-low (two-tone) routine, respectively.

FIGS. 14A–14I show flow diagrams for the timeout or service subroutines that are controlled by or enabled from the initialization subroutines 13A–13J and from the main program loop of FIG. 11. These subroutines effect such functions as servicing the timed interrupts, decoding the signal transmitted from the microphone and control handle, actually creating the siren signals and defining the ramp functions for the siren signals. As with all of the subroutines shown in FIGS. 11–14, the operation of the subroutines shown in the flow diagrams of FIGS. 14A–14I are self explanatory.

While the invention has been illustrated and described in detail in the drawings and foregoing description, the same is to be considered as illustrative and not restrictive in character. For example, the present invention need not be limited to use with only one speaker and power amplifier, but could easily be modified to operate using two speakers. Additionally, although the present invention was described incorporating a microprocessor, it can be seen that a plurality of audibly distinguishable siren tones could be simultaneously created using discrete components in place of the microprocessor. It is understood that only the preferred embodiment has been shown and described and that all changes and modifications that come within the spirit of the invention are desired to be protected.

What is claimed is:

1. An electronic siren apparatus, comprising:

a receiver including circuitry capable of generating siren tones, controlling auxiliary devices and controlling at least one warning light circuit, said receiver additionally including an amplifier connected to said circuitry for generating siren tones;

a speaker connected to said amplifier, said speaker being driven by said amplifier to emit said siren tones; and a remote control handle, including:

a first switch for designating said at least one light circuit;

a second switch for designating an output to said speaker from said amplifier;

a microphone element for detecting an audible signal at said remote control handle;

a push-to-talk switch for causing said receiver to relay said audible signal to said amplifier while said push-to-talk switch is closed;

a power supply for providing power to said receiver and said remote control handle;

wherein said first switch, said second switch and said microphone element are all contained within said remote control handle and said remote control handle is sized to be received in a hand of a user;

wherein said first switch is a four position progressive slide switch, and wherein said receiver is capable of controlling at least three external warning light circuits, said slide switch having a first position wherein all of said warning light circuits are turned off, a second position wherein a first warning light circuit is turned on by said receiver circuitry, a third position wherein said first warning light circuit and a second warning light circuit is turned on by said receiver circuitry, and a fourth position wherein said first, said second and a third warning light circuit is turned on by said receiver circuitry;

wherein said slide switch is an optical slide switch; and wherein said optical slide switch includes at least one light source and two light sensitive elements, said two light sensitive elements being placed in close proximity to said light source.

2. The electronic siren apparatus of claim 1, wherein said optical slide switch includes a switch body including a projection and a shield portion, wherein sliding said optical slide switch selectively interposes said shield portion between said light source and at least one of said light sensitive elements, so as to block said at least one light sensitive element from said light source.

3. The electronic siren apparatus of claim 2, wherein said control handle includes a housing including a track disposed below said optical switch, wherein said track mates with said projection of said optical switch to maintain said switch in a desired switch position, and wherein said switch additionally includes spring means for biasing said projection into said track.

* * * * *

UNITED STATES PATENT AND TRADEMARK OFFICE

CERTIFICATE OF CORRECTION

PATENT NO. : 5,831,515

DATED : November 3, 1998

INVENTOR(S) : Stewart, et al.

It is certified that error appears in the above-identified patent and that said Letters Patent is hereby corrected as shown below:

On the cover page, after ASSIGNEE, please change "Maunfacturing" to --Manufacturing--.
In column 2, line 46, please change "12E" to --12D--.
In column 13, line 8, please delete "3" following the word "values".
In column 13, line 37, please insert --output-- before "ports".

Signed and Sealed this

Twenty-eighth Day of December, 1999

*Attest:*

Q. TODD DICKINSON

*Attesting Officer*

*Acting Commissioner of Patents and Trademarks*